US012760512B2

(12) United States Patent
Kulkarni et al.

(10) Patent No.: US 12,760,512 B2
(45) Date of Patent: Oct. 13, 2026

(54) SYSTEMS AND METHODS FOR MANUFACTURING AND DEPLOYING MODULAR BUILDINGS

(71) Applicant: Rohe Homes Ltd., Surrey (CA)

(72) Inventors: Rohan Kulkarni, Surrey (CA); Ankush Abbi, Surrey (CA); Hyun Kyo Joo, Surrey (CA)

(73) Assignee: ROHE HOMES LTD., Surrey (CA)

( * ) Notice: Subject to any disclaimer, the term of this patent is extended or adjusted under 35 U.S.C. 154(b) by 271 days.

(21) Appl. No.: 18/280,162

(22) PCT Filed: Mar. 3, 2022

(86) PCT No.: PCT/CA2022/050308
§ 371 (c)(1),
(2) Date: Sep. 1, 2023

(87) PCT Pub. No.: WO2022/183296
PCT Pub. Date: Sep. 9, 2022

(65) Prior Publication Data

US 2024/0141639 A1 May 2, 2024

Related U.S. Application Data

(60) Provisional application No. 63/156,326, filed on Mar. 3, 2021.

(51) Int. Cl.

| | |
|---|---|
| ***E04B 1/344*** | (2006.01) |
| ***E04B 1/343*** | (2006.01) |
| ***E04H 1/12*** | (2006.01) |

(52) U.S. Cl.
CPC ..... *E04B 1/3444* (2013.01); *E04B 1/34336* (2013.01); *E04H 1/1205* (2013.01)

(58) Field of Classification Search
CPC ..... E04B 1/3444; E04B 1/34336; E04B 1/34384; E04B 1/3442; E04H 1/1205; E04H 1/12
See application file for complete search history.

(56) References Cited

U.S. PATENT DOCUMENTS 1,498,173 A * 6/1924 Kelley ..... E04B 1/3444 296/156
1,577,378 A * 3/1926 Smidley ..... A01K 1/02 52/66

(Continued)

FOREIGN PATENT DOCUMENTS

EP 3926115 A1 12/2021
IN 201811024030 A 1/2020

(Continued)

OTHER PUBLICATIONS www.abodu.com "Configure Your Abodu", online, accessed Apr. 19, 2024.

(Continued)

*Primary Examiner* — Gisele D Ford
(74) *Attorney, Agent, or Firm* — Workman Nydegger

(57) ABSTRACT

A foldable modular building having a fixed portion and at least one foldable portion where the foldable portions are hingedly connected. Methods of assembling, folding and deploying the foldable modular building utilizing hinges, cables and winches.

18 Claims, 20 Drawing Sheets

(56) References Cited

U.S. PATENT DOCUMENTS 2,006,477 A * 7/1935 Pendry ..... B60P 3/34 52/68
2,167,557 A * 7/1939 Stout ..... B60P 3/34 D12/104
2,259,783 A * 10/1941 Sparling ..... E04B 1/3442 446/478
2,395,691 A * 2/1946 Smith ..... E04B 1/3444 52/272
2,886,856 A * 5/1959 Suk ..... E04B 1/3444 52/235
3,012,291 A * 12/1961 Rice ..... E04B 1/3442 52/91.1
3,107,116 A * 10/1963 Meaker ..... B60P 3/34 52/68
3,271,065 A * 9/1966 Scuris ..... B60P 3/34 296/26.02
3,402,515 A * 9/1968 Rainaut ..... E04B 1/34 52/64
3,460,297 A * 8/1969 Fritz ..... E04H 1/02 D25/29
3,462,891 A * 8/1969 Smith ..... E04B 1/3444 52/91.1
3,653,165 A * 4/1972 West ..... E04B 1/3442 52/69
3,731,440 A * 5/1973 Welz ..... E04B 1/345 52/223.7
3,736,708 A * 6/1973 Chapman ..... E04B 1/3442 52/645
3,792,557 A * 2/1974 Pitts ..... E04B 1/3444 52/65
3,807,104 A * 4/1974 Webster ..... E04B 1/3445 135/117
3,827,198 A * 8/1974 Geihl ..... E04B 1/345 52/69
3,866,365 A * 2/1975 Honigman ..... E04B 1/3444 52/66
3,983,665 A * 10/1976 Burton ..... E04B 1/3442 52/79.5
3,984,948 A * 10/1976 Bussard ..... E04B 1/3442 52/79.5
4,074,475 A * 2/1978 Wahlquist ..... E04B 1/3445 52/143
4,118,901 A * 10/1978 Johnson ..... E04B 1/345 52/18
4,122,638 A * 10/1978 O'Brian ..... E04B 1/3445 312/258
4,155,204 A * 5/1979 Prozinski ..... E04B 1/34336 52/69
4,534,141 A * 8/1985 Fagnoni ..... E04B 1/3444 52/68
4,545,171 A * 10/1985 Colvin ..... E04B 1/3442 52/79.5
4,546,578 A * 10/1985 Behrmann ..... E04B 1/34336 52/79.5
4,603,518 A * 8/1986 Fennes ..... E04B 1/3444 52/79.5
4,633,626 A * 1/1987 Freeman ..... E04B 1/34315 52/79.5
4,780,996 A * 11/1988 Julien, Jr. ..... E04B 1/3444 52/79.5
4,829,726 A * 5/1989 de Potter d'Indoye ..... E04B 1/3444 52/64
4,891,919 A * 1/1990 Palibroda ..... E04B 1/34321 52/79.5
4,989,379 A * 2/1991 Suzuki ..... E04B 1/3442 52/66
5,345,730 A * 9/1994 Jurgensen ..... E04B 1/345 52/64
5,447,000 A * 9/1995 Larsen ..... E04B 1/34315 52/234
5,461,832 A * 10/1995 Smith ..... E04B 1/3444 52/143
5,596,844 A * 1/1997 Kalinowski ..... E04B 1/3442 52/79.5
5,761,854 A * 6/1998 Johnson ..... E04H 15/008 52/79.5
5,966,956 A 10/1999 Morris et al.
6,223,479 B1 * 5/2001 Stockli ..... E04B 1/3444 52/68
6,243,992 B1 * 6/2001 Gyllenhammar ..... B60P 3/34 296/26.05
6,253,498 B1 * 7/2001 Fanucci ..... E04B 1/3445 52/143
6,434,895 B1 * 8/2002 Hosterman ..... B62D 63/061 52/79.5
6,705,051 B1 * 3/2004 Wall ..... E04B 7/24 52/93.2
7,418,802 B2 * 9/2008 Sarine ..... E04B 1/34305 52/79.5
7,841,136 B2 * 11/2010 Czyznikiewicz ..... E04B 1/3444 52/64
8,141,304 B2 * 3/2012 Shen ..... E04B 1/3444 52/645
8,347,560 B2 * 1/2013 Gyory ..... E04B 1/34363 52/79.5
8,474,194 B2 7/2013 Tiramani
8,578,661 B1 * 11/2013 Braley ..... A01M 31/02 52/79.5
8,650,806 B1 * 2/2014 Condie ..... E04H 1/1277 52/79.5
8,733,029 B2 5/2014 Tiramani
8,739,475 B2 6/2014 Michaud et al.
8,943,759 B2 2/2015 Warner et al.
8,991,105 B2 * 3/2015 Harvey ..... E04B 1/3445 52/68
9,121,617 B2 * 9/2015 Condie ..... E04H 1/005
9,376,800 B2 6/2016 Martyn
D820,469 S * 6/2018 Watson ..... D25/29
10,400,501 B1 9/2019 Tatley et al.
10,829,029 B2 11/2020 Tiramani et al.
10,908,593 B1 2/2021 Rizon et al.
11,220,816 B2 1/2022 Tiramani et al.
11,236,505 B2 2/2022 Rivas et al.
11,365,541 B2 6/2022 Rivas et al.
11,566,413 B2 1/2023 Tiramani et al.
2002/0116878 A1 * 8/2002 Ciotti ..... E04B 1/3442 52/79.5
2003/0051417 A1 * 3/2003 Ciotti ..... E04B 1/3442 52/79.5
2004/0194396 A1 * 10/2004 Shanni ..... E04B 1/3444 52/79.5
2005/0072062 A1 * 4/2005 Aust ..... E04B 1/3431 52/79.1
2005/0283371 A1 12/2005 Tiramani
2006/0070306 A1 * 4/2006 Lin ..... E04B 1/3444 52/67
2006/0185709 A1 * 8/2006 Bzorgi ..... E04H 3/08 135/143
2006/0201072 A1 * 9/2006 Gibson ..... E04B 1/3444 52/64
2007/0144078 A1 * 6/2007 Frondelius ..... E04B 1/34305 52/67
2008/0236055 A1 * 10/2008 Laprise ..... E04B 1/3444 52/64
2008/0264463 A1 * 10/2008 Kim ..... E04B 1/3444 135/148
2009/0044460 A1 * 2/2009 Medley ..... E04B 1/3444 52/741.1
2009/0217600 A1 9/2009 De Azambuja
2009/0266006 A1 * 10/2009 Gyory ..... E04B 1/3444 52/79.5
2010/0011676 A1 * 1/2010 Barry ..... E04B 1/3444 52/79.5
2010/0043308 A1 * 2/2010 Keeble ..... E04B 1/34321 52/741.1

(56) References Cited

U.S. PATENT DOCUMENTS

2010/0064599 A1* 3/2010 Yang ..... E04B 1/3444 52/79.5
2010/0192481 A1* 8/2010 Shen ..... E04B 1/3444 52/79.5
2010/0218453 A1* 9/2010 Gibson ..... E04B 1/3444 52/745.1
2010/0269419 A1* 10/2010 Gyory ..... E04B 1/34384 52/79.5
2011/0094167 A1* 4/2011 Noiseux ..... E04H 1/1222 52/79.5
2011/0126479 A1* 6/2011 Alford ..... E04B 1/3442 52/79.5
2011/0259768 A1* 10/2011 Campbell ..... E04B 1/3444 206/216
2012/0006369 A1* 1/2012 Cantin ..... E04B 1/34384 135/96
2012/0060430 A1* 3/2012 Laprise ..... E04B 1/3442 52/79.5
2012/0255240 A1* 10/2012 Shen ..... E04B 1/34807 52/79.5
2012/0265005 A1* 10/2012 Han ..... E04B 1/3442 600/21
2012/0279142 A1 11/2012 Michaud
2013/0019913 A1* 1/2013 Zadok ..... E04B 1/3442 135/96
2013/0074424 A1* 3/2013 Trascher ..... E04B 1/34384 52/79.5
2013/0232887 A1* 9/2013 Donnini ..... E04B 1/3442 52/79.5
2013/0291449 A1* 11/2013 Strickland ..... E04B 1/3442 52/79.5
2013/0305626 A1* 11/2013 Strickland ..... E04B 1/3444 52/79.5
2014/0033619 A1* 2/2014 Merchant ..... E04B 1/3444 52/71
2014/0047778 A1* 2/2014 DiGregory ..... B41F 9/063 52/79.5
2014/0059947 A1 3/2014 Rothwell et al.
2014/0144088 A1* 5/2014 Heger ..... E04B 1/34384 52/79.5
2014/0150352 A1* 6/2014 Lee ..... E04B 1/3444 52/79.5
2014/0157685 A1* 6/2014 Fagan ..... E04H 1/1205 52/79.5
2014/0202089 A1* 7/2014 Nakajima ..... B60P 3/34 52/79.5
2014/0311051 A1 10/2014 Fagan
2014/0311052 A1* 10/2014 Farmer ..... E04B 1/3442 52/79.5
2015/0218794 A1* 8/2015 Martyn ..... E04B 1/3445 52/79.5
2015/0246699 A1* 9/2015 Anabtawi ..... B60D 1/06 280/504
2015/0315776 A1* 11/2015 Duncan ..... E04B 1/3444 52/66
2016/0032587 A1 2/2016 Michaud et al.
2016/0069062 A1* 3/2016 Dynon ..... E04B 1/34336 52/79.5
2016/0138258 A1* 5/2016 Schaffert ..... E04B 1/3445 52/79.5
2017/0030071 A1* 2/2017 Sorensen ..... E04B 7/163
2017/0037612 A1* 2/2017 Duncan ..... E04H 1/1205
2017/0051497 A1* 2/2017 Kolbe ..... E04H 1/1205
2020/0198520 A1 6/2020 Tiramani et al.
2020/0224406 A1* 7/2020 Brezan ..... E04H 1/1205
2021/0246675 A1* 8/2021 Pearce ..... E04B 1/3448
2021/0262220 A1 8/2021 Tiramani et al.
2021/0381228 A1 12/2021 Rivas et al.
2022/0112714 A1 4/2022 Rivas et al.
2022/0127840 A1* 4/2022 Giacomini ..... E04B 1/34384
2022/0220721 A1 7/2022 Tiramani et al.
2022/0220722 A1 7/2022 Tiramani et al.
2022/0220723 A1 7/2022 Tiramani et al.
2022/0220726 A1 7/2022 Tiramani et al.
2022/0220729 A1 7/2022 Tiramani et al.
2022/0220739 A1 7/2022 Tiramani et al.
2022/0220758 A1 7/2022 Tiramani et al.
2022/0228361 A1* 7/2022 Hoddinott ..... E04B 1/3483
2023/0082695 A1* 3/2023 James ..... E04B 1/3445 52/66

FOREIGN PATENT DOCUMENTS

IN 202241057712 A 12/2022
KR 100345687 B1 7/2002
WO 2014037689 A1 3/2014
WO 2014037691 A1 3/2014
WO 2014125244 A1 8/2014
WO 2022154844 A1 7/2022
WO 2022154855 A1 7/2022
WO 2022154886 A1 7/2022
WO 2022231680 A1 11/2022

OTHER PUBLICATIONS https://builtprefab.com/product/build-and-price-your-home/#floorplan, online, accessed Apr. 19, 2024.

* cited by examiner

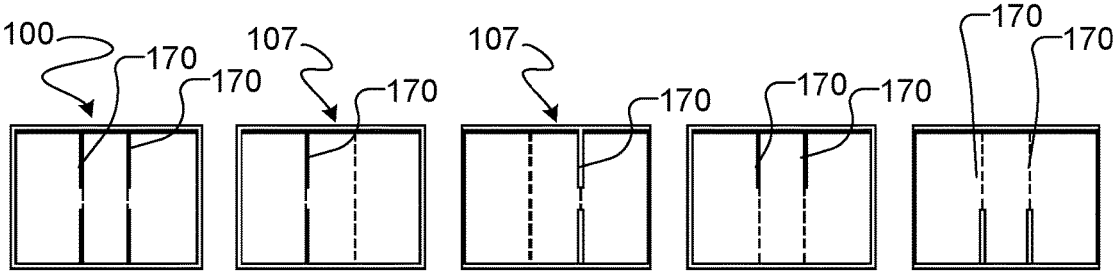
FIG. 11A FIG. 11B FIG. 11C FIG. 11D FIG. 11E
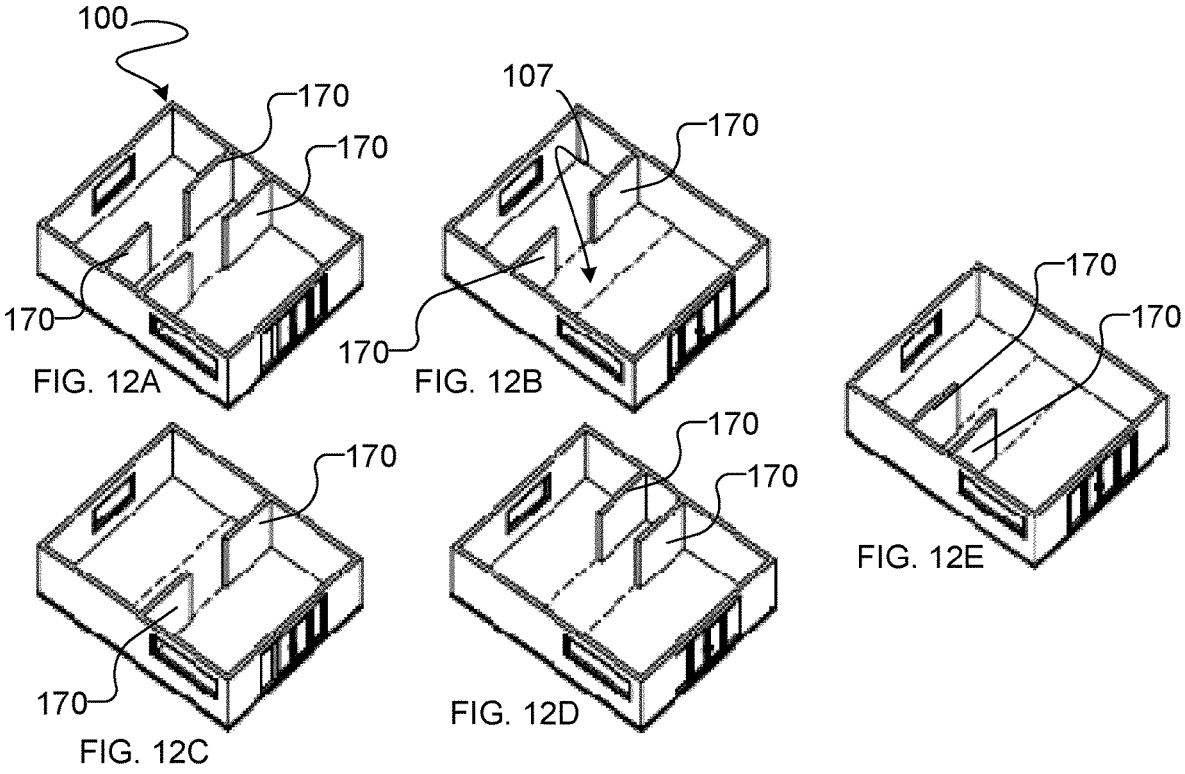

SYSTEMS AND METHODS FOR MANUFACTURING AND DEPLOYING MODULAR BUILDINGS

REFERENCE TO RELATED APPLICATIONS

This application is a national stage entry of Patent Cooperation Treaty patent application No. PCT/CA2022/050308, which claims priority to, and the benefit of, U.S. provisional patent application No. 63/156,326 filed 3 Mar. 2021. The entirety of each of the foregoing applications the entirety of which is incorporated by reference herein for all purposes.

TECHNICAL FIELD

Some embodiments relate to modular homes. Some embodiments relate to foldable modular homes that can be readily shipped to a desired deployment location and erected at the desired deployment location.

BACKGROUND

In recent times, prefabricated building construction system modules and space creators are seen as a dependable alternative to constructing traditionally. Also, foldable space creating modules can be a useful method of building construction.

Building construction modules are manufactured on a production line and transported to the place of installation. At the installation site, these modules are unfolded to form a complete building structure. Foldable modules are convenient to install and can be easily transported from one place to another.

Traditional methods of construction take a lot of time and effort to build structures. Further, once built, it may be either impossible or extremely time and labor intensive to relocate the traditional structures and buildings to some other place, in case a need for relocation arises. Foldable modules thus provide a good alternative to the traditional forms of construction as they can easily be transported and installed at a required site.

Foldable modules, in general, may have folded walls, roofs, and floors that create spaces and rooms. The foldable module can be transported to a place of installation and thereafter the wall, roofs, and floors can be unfolded from the central structure to create spaces and rooms around the central structure.

In conventional foldable modules, the foldable walls, floors, are often folded such that they take up as little space as possible. While this makes the foldable modules compact and easy to transport, the multiple folds may compromise the overall strength of the modular building system. When such a foldable module is constructed by opening up the foldable walls, floors, roofs etc., the structure can exhibit low structural integrity, may be unable to support significant weight, and may be susceptible to collapsing prematurely.

To address the issues related to compromised structural strength, some conventional foldable modular structures include as few folds as possible. While this approach may enhance the strength of the modular structure, the size of the resulting collapsed module may often be large, compromising its transportability. Thus, conventional foldable modular structures can be folded in such a way that either it takes up more space or compromises with the strength of the finished housing structure.

There is a general desire for improved systems and methods for easily fabricating, transporting and/or installing modular buildings. There is a general desire for improved systems and methods for fabricating, transporting and/or installing modular buildings that have greater strength and resilience in their final deployed configuration.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In one aspect, a foldable modular building has a fixed portion having a central floor panel, a central roof panel above the central floor panel, a pair of central sidewalls, each one of the pair of central sidewalls being disposed at opposite ends of the central floor panel, the pair of central sidewalls interposing the central floor panel and the central roof panel, the central floor panel, the central roof panel, and the pair of central sidewalls together providing the fixed portion of the foldable modular building, and at least one foldable portion having a lateral floor panel hingedly connected to an outside lateral edge of the central floor panel, a lateral roof panel hingedly connected to an outside lateral edge of the central roof panel, a pair of outside wall panels, each one of the pair of outside wall panels being hingedly connected to an outside lateral edge of a corresponding one of the pair of central sidewalls; and an outer lateral sidewall, the outer lateral sidewall being hingedly connected to an outside lateral edge of the lateral floor panel, and a lateral support beam, the lateral support beam being dimensioned to contact an outside lateral edge of the lateral floor panel and a bottom edge of the outer lateral sidewall.

In one aspect, a foldable modular building having a central roof panel and at least one lateral roof panel, wherein the lateral roof panel is hingedly connected to the central roof panel so that the lateral roof panel is rotatable downwardly and inwardly between a deployed position in which the lateral roof panel is disposed parallel to and in the same plane as the central roof panel and a folded position in which the lateral roof panel extends perpendicular to the central roof panel is provided.

In one aspect, a method of deploying a foldable modular building is provided, including the steps of folding a lateral roof panel that is hingedly connected to a central roof panel of the foldable modular building upwardly and outwardly from a folded position in which the lateral roof panel extends perpendicularly downwardly from the central roof panel to a deployed position in which the lateral roof panel extends parallel to and in the same plane as the central roof panel.

In one aspect, a method of deploying a foldable modular building is provided, involving rotating a unit having an outer lateral sidewall and a lateral floor panel outwardly and downwardly away from a fixed portion of the foldable modular building until the unit extends parallel to a central floor panel of the fixed portion with the lateral floor panel extending in the same plane as the central floor panel and the outer lateral sidewall stacked above the lateral floor panel, positioning a lateral support beam adjacent an outer lateral edge of the lateral floor panel, rotating the outer lateral sidewall upwardly and outwardly relative to the lateral floor panel until the outer lateral sidewall extends perpendicularly upwardly from the lateral floor panel, with the lateral support beam interposing the outer lateral sidewall and a foundation on which the foldable modular building is deployed, and rotating outside wall panels horizontally and outwardly away from the fixed portion until the outside wall panels extend parallel to and in the same plane as central sidewalls of the fixed portion.

In one aspect, a method of deploying a foldable modular building having a fixed portion and a foldable portion is provided, involving tightening outer lateral sidewalls of the foldable modular building in its deployed configuration inwardly towards a fixed portion of the foldable modular building, tightening lateral floor panels of the foldable modular building in its deployed configuration inwardly towards the fixed portion of the foldable modular building, and tightening lateral roof panels of the foldable modular building in its deployed configuration inwardly towards the fixed portion of the foldable modular building.

In some aspects, the foldable modular building includes recessed windows. The recessed windows can have a frame inset within the perimeter of an opening in a panel in which the window, the frame together with the perimeter of the opening defining a recess within the opening for receiving the window to allow the window to be installed flush with the outer surface of the panel.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

FIGS. 11A-11E show an example embodiment of a method of placing, or potential configurations for, service walls.

FIGS. 12A-12E illustrates a method of placing, or potential configurations for, service walls.

DESCRIPTION

Figure 1A:
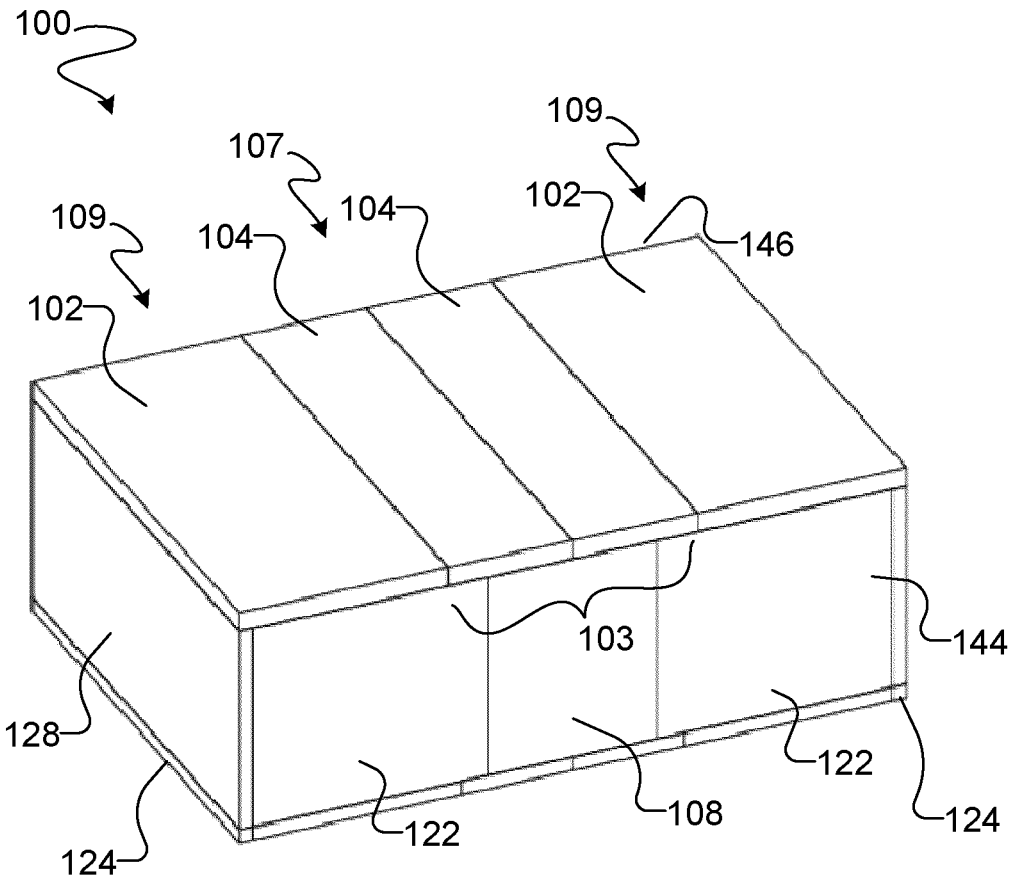
FIG. 1A shows an example embodiment of an assembled modular building structure in its assembled unfolded configuration.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Examples of buildings or structures as used herein include homes, shops, offices, hotels, health centers, or the like.

As used herein, the relative term "inward" means in a direction towards a central core of a building, and the relative term "outward" means in a direction away from the central core of the building. The terms "upward", "downward", "vertical" and "horizontal" are used with their conventional meanings having regard to the orientation of the exemplary embodiments illustrated in the drawings and the intended direction of use of the foldable modular buildings described herein. It will be appreciated by those skilled in the art that the foldable modular buildings could be placed into other orientations, particularly during shipping or transport, if desired. Moreover, while the directional terms "parallel" and "perpendicular" have been used herein, such references should be understood as not requiring that components be perfectly parallel or perfectly perpendicular; rather, those skilled in the art will understand that there are certain manufacturing tolerances such that slight misalignments may occur but still yield a functioning structure.

In some embodiments, the inventors have now developed a foldable modular building system comprising foldable entities that are folded such that they occupy substantially reduced space and yet do not significantly compromise with the strength of the modular structure when expanded. According to some embodiments, the foldable module when folded may have a size of about one third to one half the size of the fully expanded module. Thus, due to such reduction in size, the foldable module of some embodiments can be conveniently transported to an installation site by an adequate transportation means and thereafter unfolded to create a structure.

In an example implementation, the module comprises a central expandable unit which is unfolded at the installation site to create a structure. The central expandable unit is a box-like structure and comprises an upper panel and a lower panel. The upper panel forms the ceiling of the central expandable unit and the lower panel forms the floor of the central expandable unit. The central expandable unit further comprises a plurality of vertical panels, between the upper panel and the lower panel, which serves as the walls of the central expandable unit. Further, the central expandable unit comprises at least one floor sheet collapsed on a vertical panel of the central expandable unit wherein the floor sheet is pivotally supported on the lower edge of the central expandable unit. The collapsed floor sheet is unfolded such that it abuts the lower panel of the central expandable unit. The floor sheets further comprise three folded wall sheets which when unfolded forms three walls standing vertically on the floor sheet. The central expandable unit further comprises a roof sheet which is coupled with the upper panel or one of the wall sheets of the central expandable unit. The roof sheet may be extended out such that it forms the ceiling of the floor sheet.

Figure 1B:
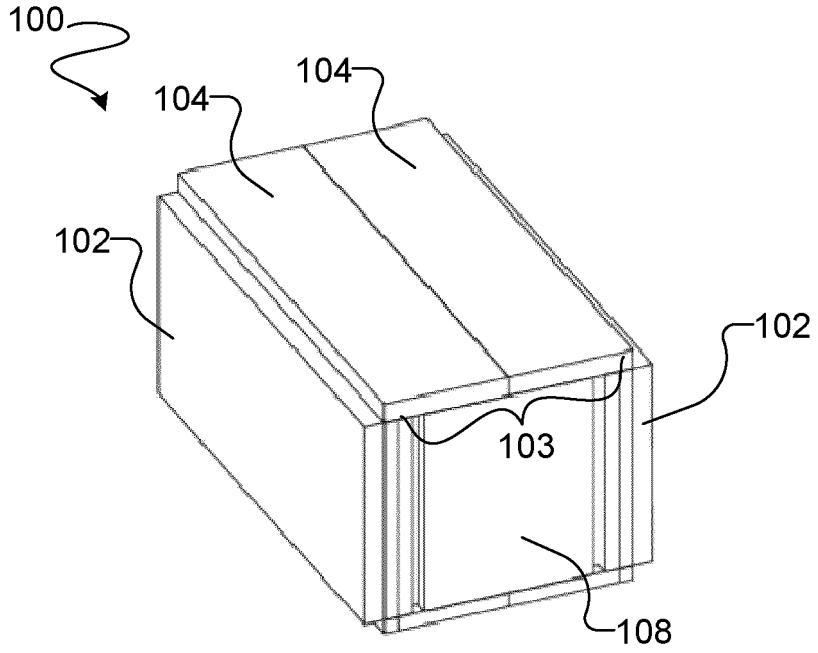
FIG. 1B shows the FIG. 1A embodiment in its assembled folded configuration.

With reference to FIGS. 1A and 1B, an example embodiment of a modular building structure 100 is shown in its assembled unfolded (i.e. deployed) and assembled folded configurations, respectively. Modular building structure 100 has a front face 144 and a rear face 146, which are mirror images of one another in some embodiments.

In the views shown in FIGS. 1A and 1B and 2A-2Q, modular building structure 100 is illustrated independent of the foundation 101 or other structure upon which modular building structure 100 is erected or is assembled on. Generally speaking, modular building structure 100 should be assembled and deployed on a generally level foundation, which can be a specifically created foundation 101, e.g. of wood, poured concrete, helical piles, steel framed, or the like, or which can be a portion of ground or rock which has been flattened to provide a generally flat surface, or any other suitable foundation upon which a building structure can be erected.

As can be seen in FIG. 1A showing the deployed configuration, modular building structure 100 has a central pair of roof panels 104, with a pair of lateral roof panels 102 provided, one on either side of central roof panels 104. In the illustrated embodiment, a pair of roof panels 104 is coupled together in any suitable manner to act as the central roof panel 103, but in alternative embodiments a single panel could be used, or a plurality of additional panels coupled together in any suitable manner.

As can be seen in FIG. 1B, which shows modular building structure 100 in its folded configuration, each one of lateral roof panels 102 is foldably connected to its adjacent central roof panel 104 so that each one of lateral roof panels 102 can be inwardly folded to render modular building structure 100 compact for transport as described in greater detail herein. It can be seen that modular building structure 100 can provide three notional rooms, one room under each of lateral roof panels 102 (i.e. the foldable portions 109 of modular building structure 100) and one central room under the pair of central roof panels 104 (i.e. the fixed portion 107 of modular building structure 100). In some embodiments, one of the notional rooms could be omitted, so that modular building structure 100 has only one fixed portion 107 and one folding portion 109 (e.g. only one lateral roof panel 102 may be provided, rather than the pair of lateral roof panels 102 illustrated).

For ease of description, the central portion of modular building structure 100 that is positioned beneath central roof panels 104 can be referred to as a "fixed portion" 107, that is a portion which does not fold. In contrast, the two lateral side portions that are positioned beneath lateral roof panels 102 can be referred to as a "foldable portion" 109, that is a portion which folds to yield a more compact structure when the modular building structure 100 is in its folded configuration, as shown in FIG. 1B.

In various embodiments, the panels described herein, including roof panels 104, lateral roof panels 102 and the like, can be made from any suitable material, for example, wood, bamboo, metal (including steel), polymers, plastic or other suitable natural or synthetic materials, framed lumber, framed steel, cross-laminated timber (CLT), or any panelized wall system now existing or developed in future. In some embodiments, insulation is provided as part of the panels. In some embodiments, structural insulating panels are used. In some embodiments, the insulation is thermal insulation and/or sound insulation. In some embodiments, the panels described herein are structural insulated panels having a foam core with a protective interior and exterior facings such as oriented strand board, as are known in the art.

In various embodiments, the foldable connections between adjacent panels that are foldably or hingedly connected together as described herein can be made using any type of hinge or other supporting structure that allows for the folding of adjacent panels. For example, any suitable type of hinge mechanism such as piano hinges, steel ball bearing hinges, geared hinges, or the like, may be used.

Figure 2A:
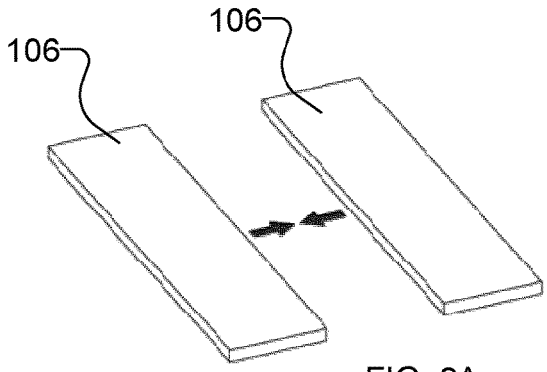
FIGS. 2A-2Q show various stages in the assembly of an example embodiment of a modular building structure.
Figure 2B:
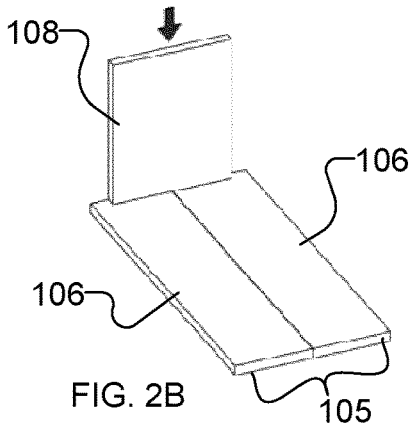
Figure 2C:
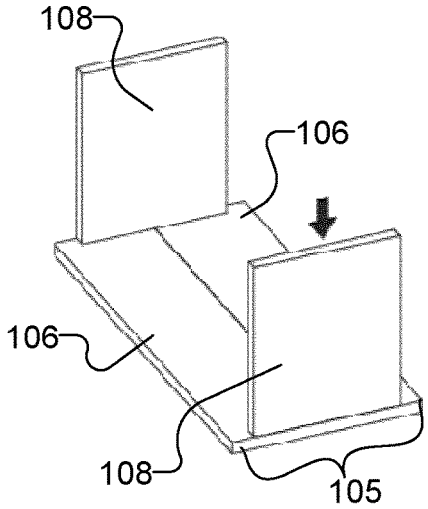
Figure 2D:
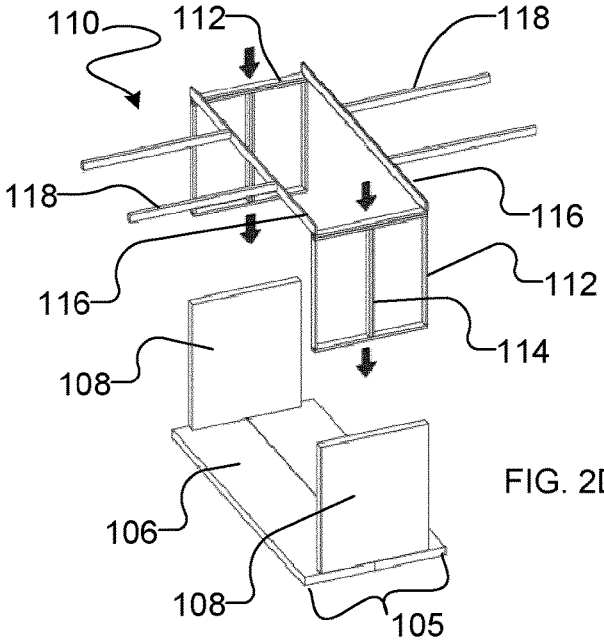
Figure 2E:
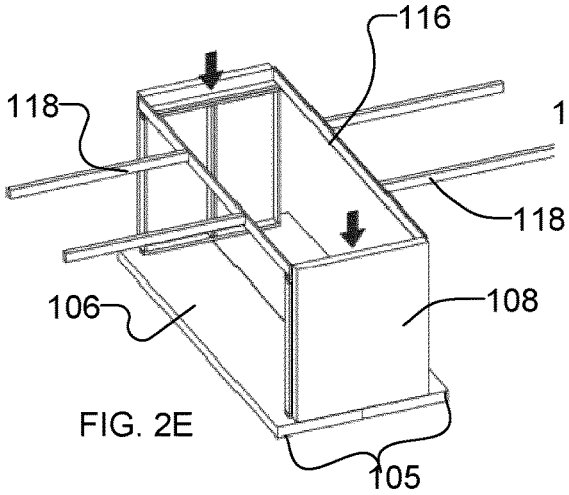
Figure 2F:
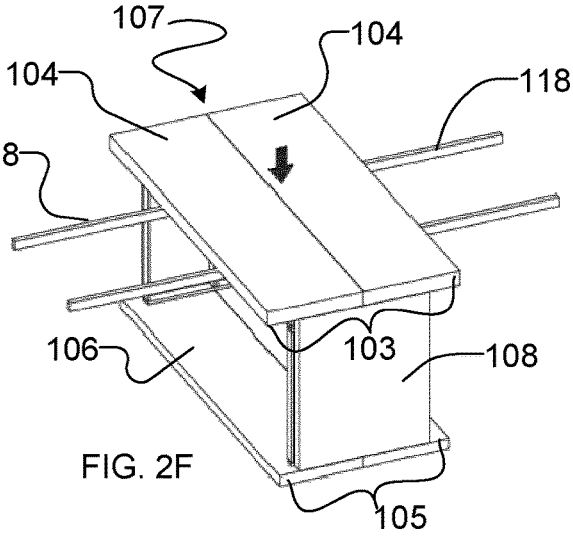
Figure 2G:
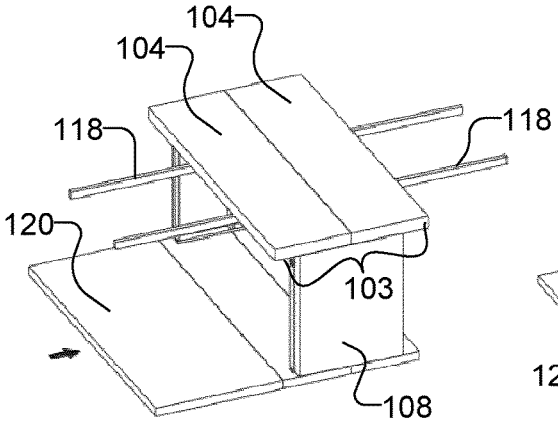
Figure 2H:
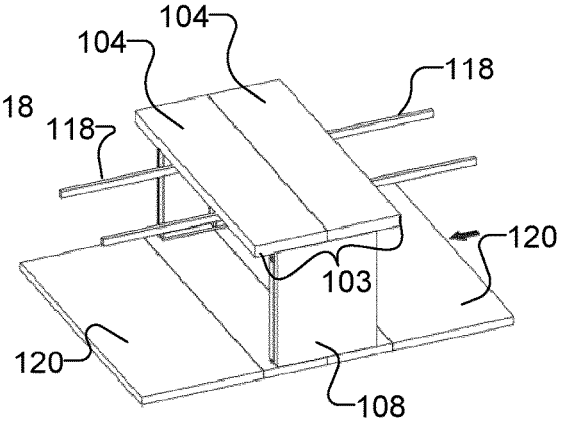
Figure 2I:
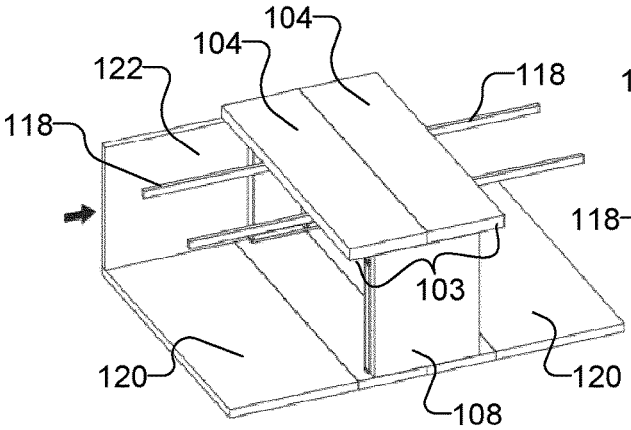
Figure 2J:
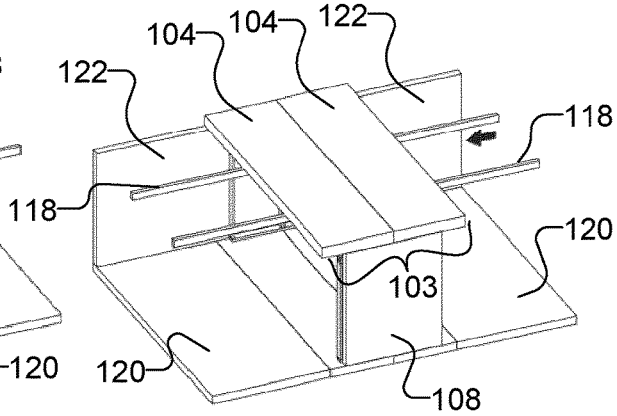
Figure 2K:
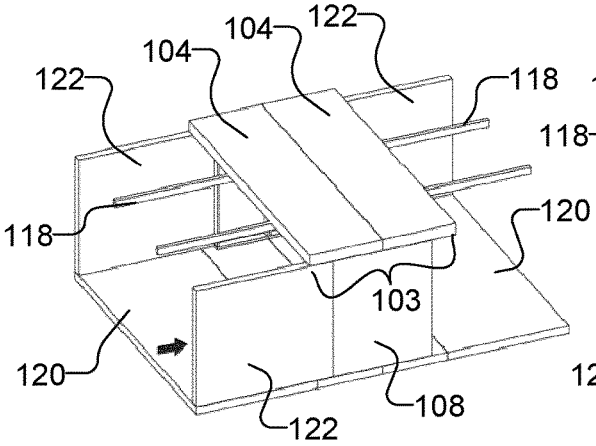
Figure 2L:
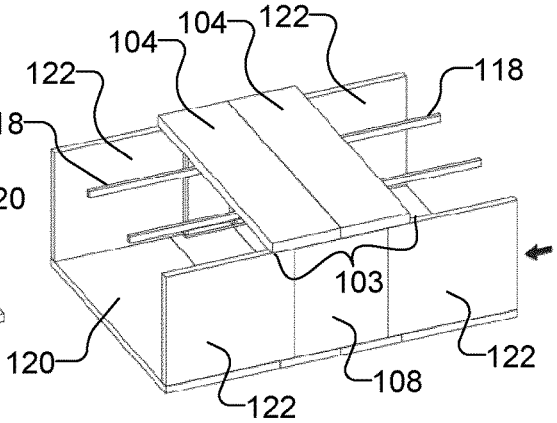
Figure 2M:
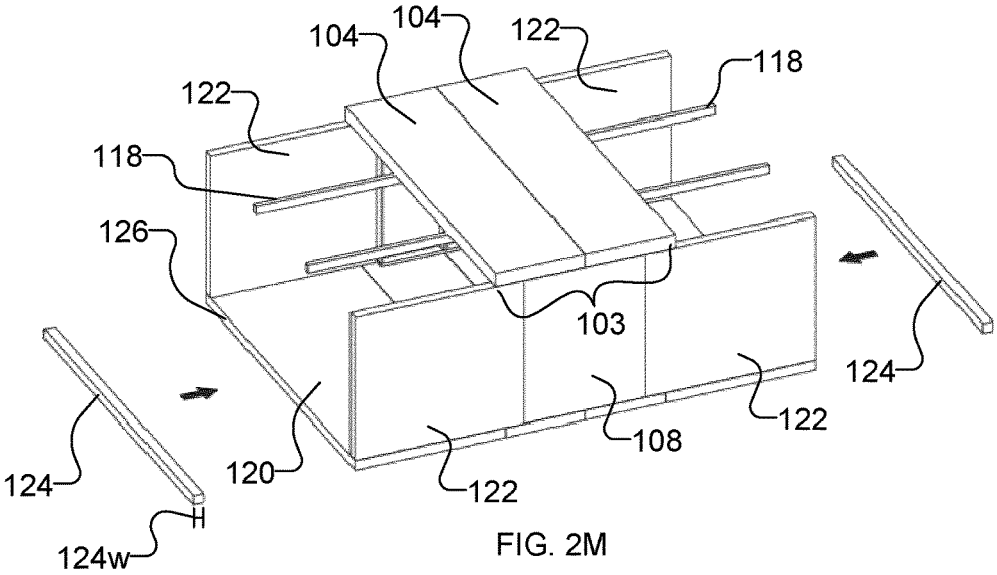
Figure 2N:
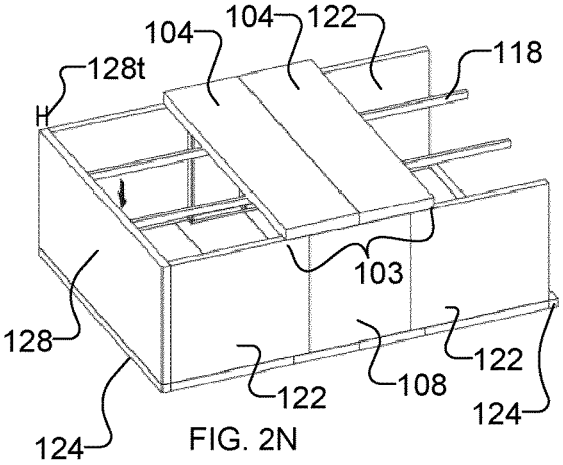
Figure 2O:
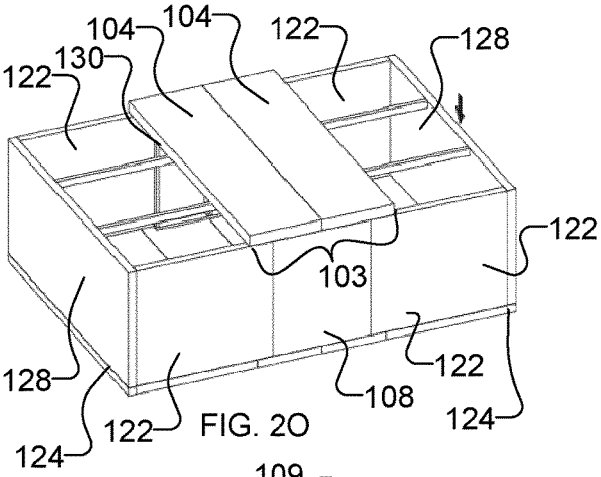
Figure 2P:
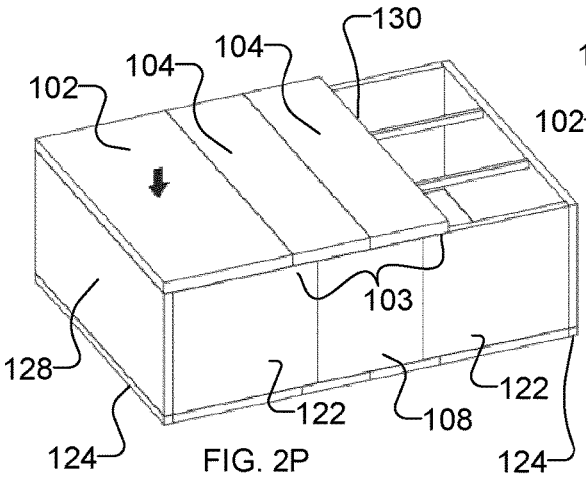
Figure 2Q:
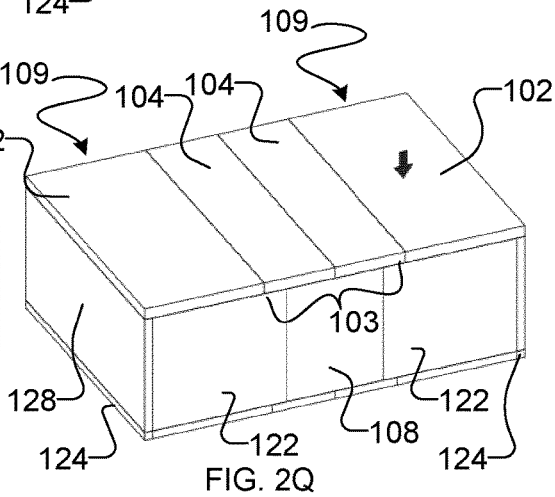

With reference to FIGS. 2A-2Q, an example sequence for assembling an example embodiment of modular building structure 100 is illustrated. With reference to FIG. 2A, initially a pair of central floor panels 106 are coupled together along their adjacent lateral edge to form central floor panel 105, which defines the bottom of the fixed portion 107. In the illustrated embodiment, a pair of floor panels 106 are coupled together in any suitable manner to act as the central floor panel 105, but in alternative embodiments a single panel could be used, or a plurality of additional panels coupled together in any suitable manner could be used. With reference to FIGS. 2B and 2C, a pair of opposed central sidewalls 108 disposed at opposite ends of the assembled central floor panels 106 can be coupled to central floor panels 106. While in the illustrated embodiment, opposed central sidewalls 108 are disposed precisely in alignment with the end surfaces of central floor panels 106 to provide the maximum amount of interior room within fixed portion 107 relative to the size of the structure, in alternative embodiments, opposed central sidewalls 108 need not be disposed exactly at the ends of central floor panels 106 and could instead be disposed only proximate to the ends of central floor panels 106.

With reference to FIG. 2D, a supporting frame 110 can be inserted and coupled to central sidewalls 108 and central floor panels 106 to provide structural rigidity. Any suitable configuration can be used for supporting frame 110, and the illustrated embodiment is only exemplary. Further, supporting frame 110 can be affixed together in any suitable manner, for example using fasteners such as screws or nails, click joints, adhesives or the like. In the illustrated embodiment, supporting frame 110 has a pair of side supports 112 formed in the shape of a rectangular frame and strengthened with a vertically extending crossbrace 114. Side supports 112 are coupled to one another via horizontal frame members 116. A pair of outwardly extending supports 118 is provided on each outward side of horizontal frame members 116.

With reference to FIG. 2E, supporting frame 110 can be slid into position between opposed central sidewalls 108 and secured in position, and with reference to FIG. 2F, central roof panels 104 can be fastened into position above horizontal frame members 116 and central sidewalls 108, so that central sidewalls 108 interpose central floor panels 106 and central roof panels 104. With reference to FIGS. 2G and 2H, a pair of lateral floor panels 120 can be added, one on each opposite lateral side of central floor panels 106. Lateral floor panels 120 are each hingedly coupled to an outside lateral edge of a corresponding one of central floor panels 106, to allow for folding of modular building structure 100 as described below by rotating lateral floor panels 120 upwardly and inwardly. In the deployed configuration, lateral floor panels 120 extend parallel to and in the same plane as central floor panels 106.

With reference to FIGS. 2I, 2J, 2K and 2L, four outside wall panels can be added, one on each opposed end of lateral floor panels 120. In the illustrated embodiment, each one of the outside wall panels 122 is hingedly connected to a corresponding outside lateral edge of one of central sidewalls 108, to facilitate rotating outside wall panels 122 horizontally inwardly when modular building structure 100 is folded as described below.

With reference to FIG. 2M, a pair of lateral support beams 124 can be provided, one along each outside lateral edge 126 of lateral floor panels 120. Lateral support beams 124 can be constructed of any suitable material, including wood, bamboo, metal (including steel), polymers, plastic or other suitable natural or synthetic materials; or a cut portion of structural insulated panel, cross-laminated timber (CLT), or any panelized wall system now existing or developed in future, or the like.

With reference to FIGS. 2N and 2O, a pair of outer lateral sidewalls 128 can be added above each lateral support beam 124. In some embodiments, lateral support beams 124 vertically support the outer lateral sidewalls 128 in their deployed position, optionally including during assembly as illustrated, and interpose the outer lateral sidewalls 128 and any foundation or the ground upon which modular building structure 100 is erected. Once outer lateral sidewalls 128 are set in position using lateral support beam 124, then outer lateral sidewalls 128 can be hingedly coupled to the outside lateral edge of lateral floor panel 120 so that outer lateral sidewalls 128 are rotatable inwardly and downwardly towards lateral floor panels 120 as described below. In their deployed configuration, outer lateral sidewalls 128 extend perpendicular to and interpose both lateral roof panel 102 and lateral floor panel 120. Lateral support beams 124 provide a structural support for outer lateral sidewalls 128 during assembly and also in deployment, but can be removed to allow for folding of modular building structure 100 as described below. If desired, in alternative embodiments, outer lateral sidewalls 128 can be assembled without using lateral support beams 124 but can instead be supported in position while coupling to lateral floor panel 120 in any other suitable manner, e.g. using any suitable type of supporting mechanism or manual support.

In the illustrated embodiment, lateral support beams 124 have a width 124*w* that is the same as a thickness 128*t* of outer lateral sidewalls 128, so that the outer edges of lateral support beams 124 are vertically aligned with the outer edge of outer lateral sidewall 128 when modular building structure 100 is in its deployed configuration. In alternative embodiments, width 124*w* could be slightly greater or slightly smaller than thickness 128*t*, so long as lateral support beams 124 are able to vertically support outer lateral sidewalls 128 when modular building structure 100 is deployed.

Figure 3A:
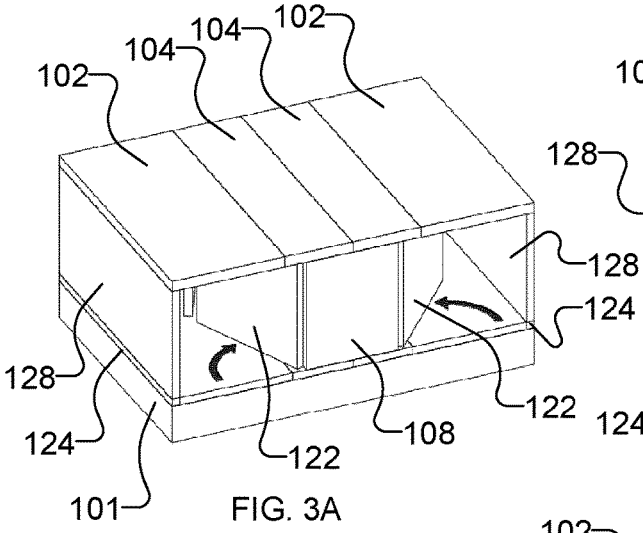
FIGS. 3A-3K show various stages in the folding of an example embodiment of a modular building structure, e.g. subsequent to assembly and prior to transport.
Figure 3B:
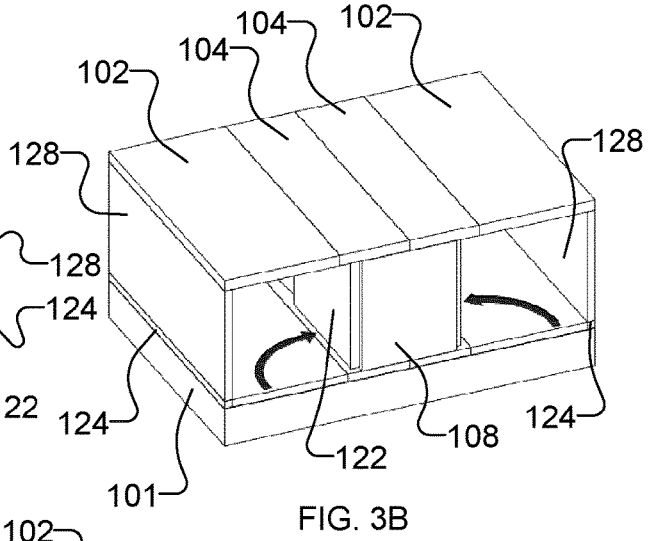
Figure 3C:
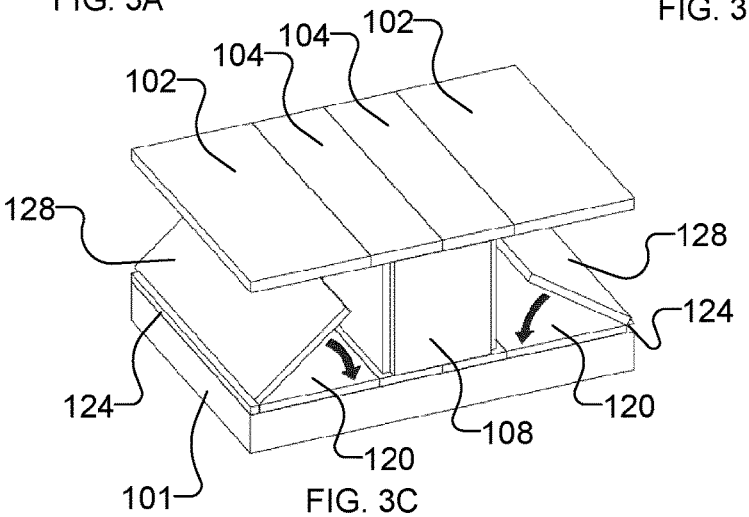
Figure 3D:
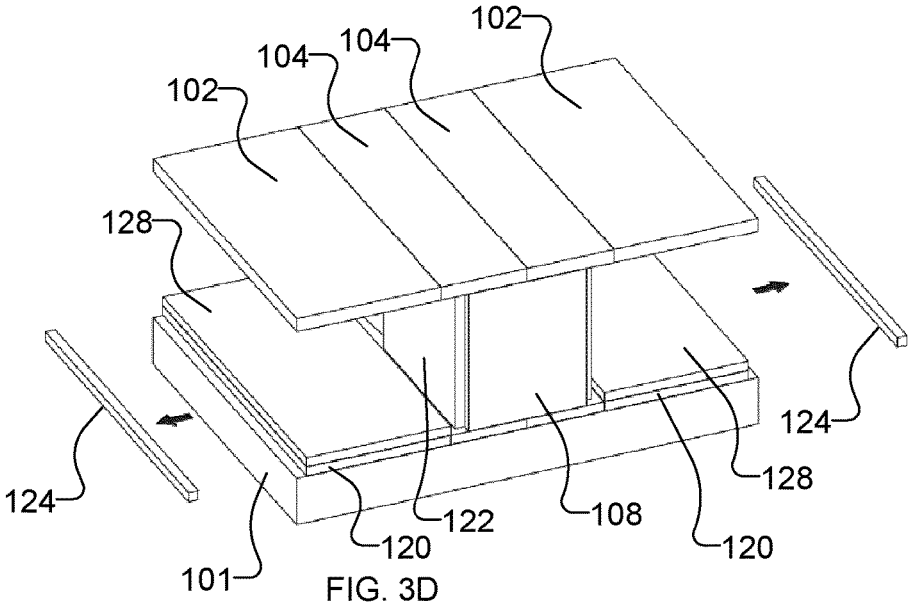

In some embodiments, including the illustrated embodiment, the dimensions of lateral floor panels 120 and outer lateral sidewalls 128 are the same, so that when these components are folded together as described below, they overlie each other on all sides, e.g. as shown in FIG. 3D.

Finally, with reference to FIGS. 2P and 2Q, a pair of lateral roof panels 102 can be put into position and hingedly connected along each outside lateral edge 130 of central roof panels 104 to yield the assembled modular building structure 100 in its unfolded or deployed configuration as shown in FIG. 1A. In the deployed configuration, lateral roof panels 102 extend parallel to and in the same plane as central roof panels 104. Each outside roof panel 102 is hingedly coupled to an outside lateral edge of a corresponding one of central roof panels 104 so that the outside roof panel 102 is rotatable inwardly and downwardly with respect to central roof panel 104 as described below. The region between each outside roof panel 102 and lateral floor panel 120 defines a foldable portion 109 of modular building structure 100.

With reference to FIGS. 3A-3K, an example method of folding of the exemplary modular building structure 100 illustrated is illustrated. In FIGS. 3A-3K, modular building structure 100 is illustrated as being positioned upon a foundation 101, and for simplicity supporting frame 110 has not been illustrated. The person skilled in the art would be able to disassemble supporting frame 110 to facilitate the folding and transport of modular building structure 100 as described herein. For example, with reference to the illustrated embodiment of FIGS. 2A-2Q, outwardly extending supports 118 are removed during folding, while the remaining components of supporting frame 110 that form part of fixed portion 107 remain in place.

With reference to FIGS. 3A and 3B, each one of the outside wall panels 122 is rotated horizontally inwardly relative to the central sidewall 108 to which it is hingedly connected until the outside wall panels 122 are perpendicular to central sidewalls 108. With reference to FIG. 3C, each one of the outer lateral sidewalls 128 is rotated inwardly and downwardly towards the lateral floor panel 120 to which it is hingedly connected, until it is parallel to and sits in a plane above lateral floor panel 120.

Figure 3E:
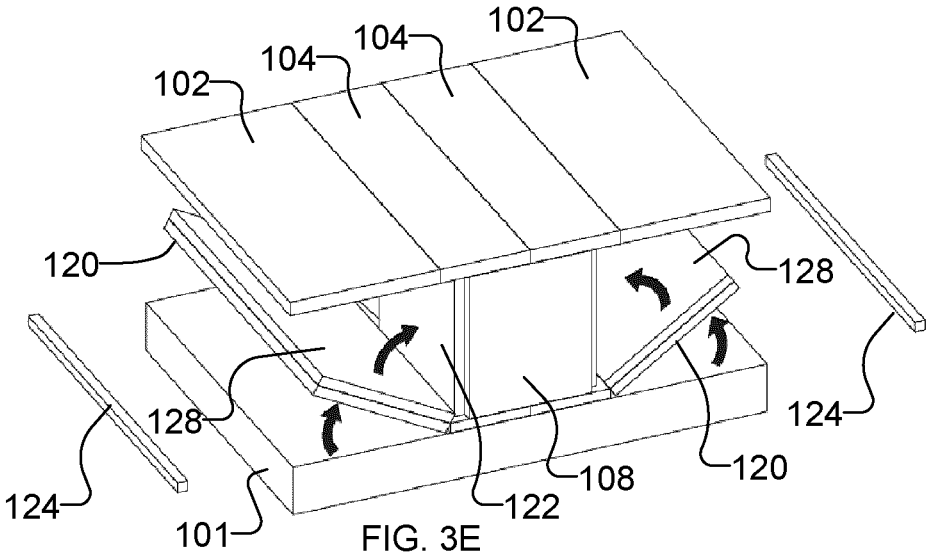
Figure 3F:
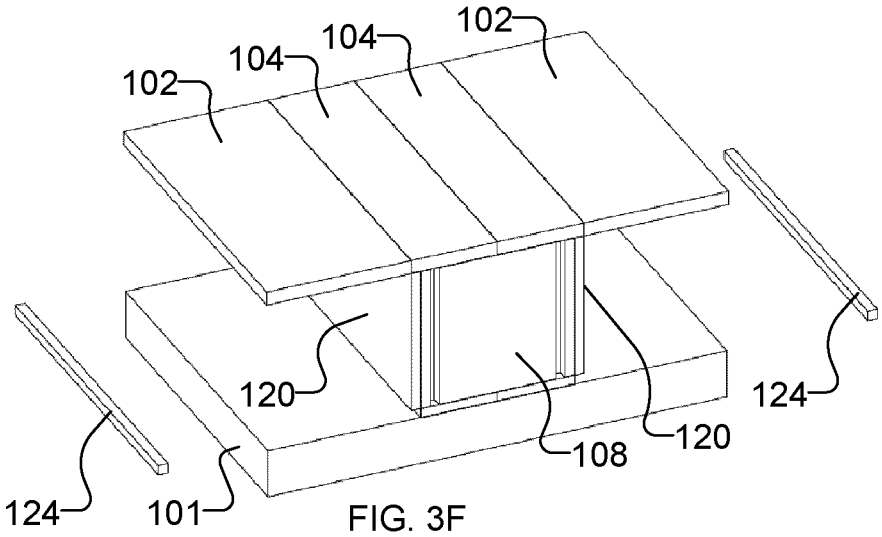

With the outer lateral sidewalls 128 folded, as shown in FIG. 3D lateral support beams 124 can be removed so as not to interfere with subsequent folding steps. As shown in FIG. 3E, the combined structural element formed by outer lateral sidewall 128 folded against lateral floor panel 120 can be folded inwardly and upwardly to rest against outside wall panels 122, which are themselves folded at a 90° angle inwardly relative to central sidewalls 108. This yields the compact central structure shown in FIG. 3F in which lateral sidewall 128 and lateral floor panel 120 extend in a direction perpendicular to and interpose central roof panel 103 and central floor panel 105, while outside wall panels 122 interpose fixed portion 107 and lateral sidewall 128/lateral floor panel 120.

Figure 3G:
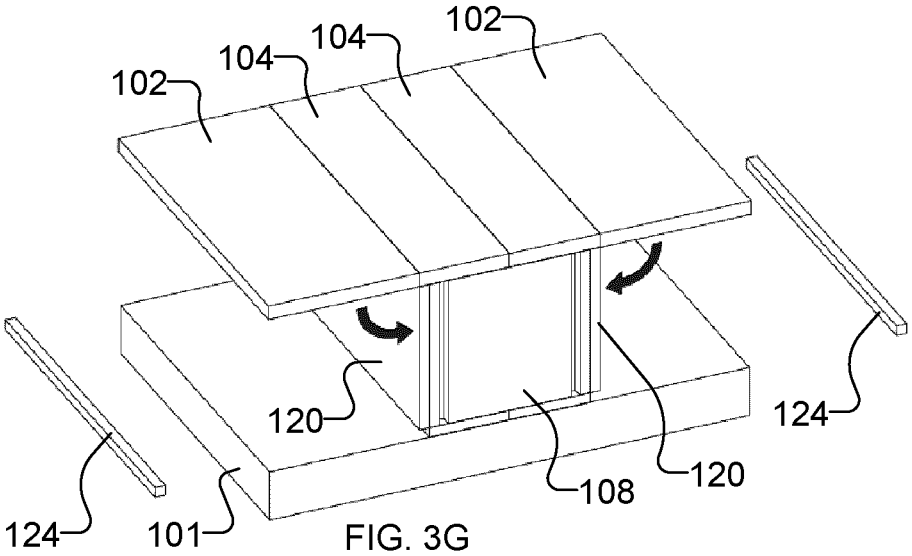
Figure 3H:
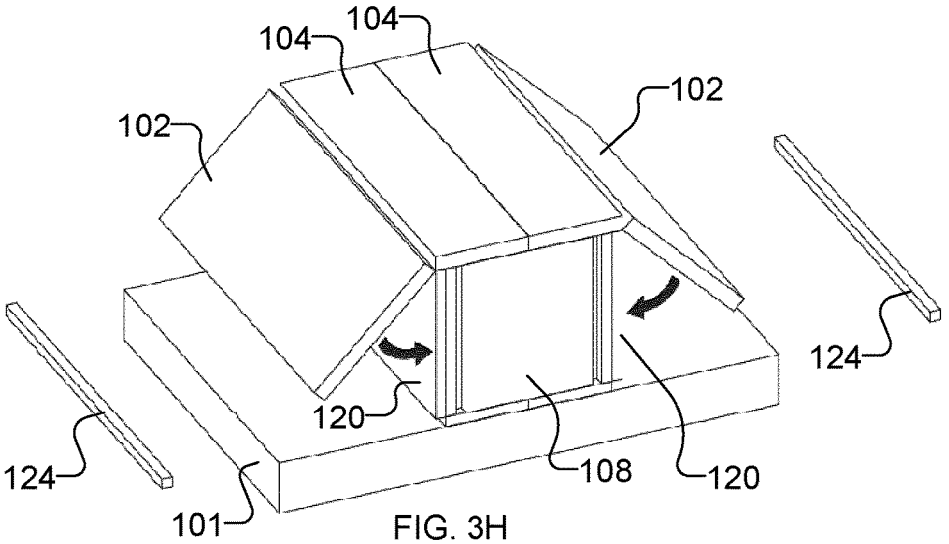
Figure 3I:
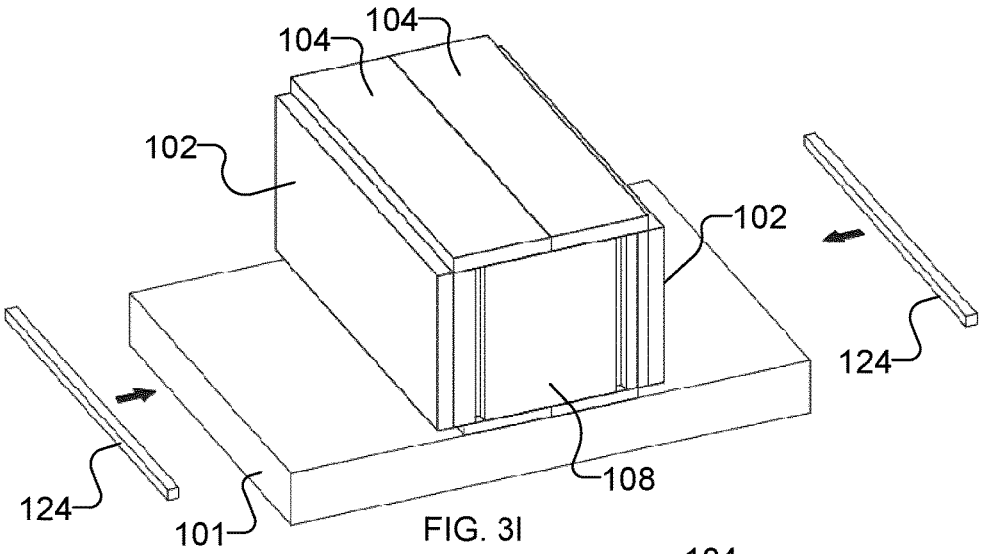
Figure 3J:
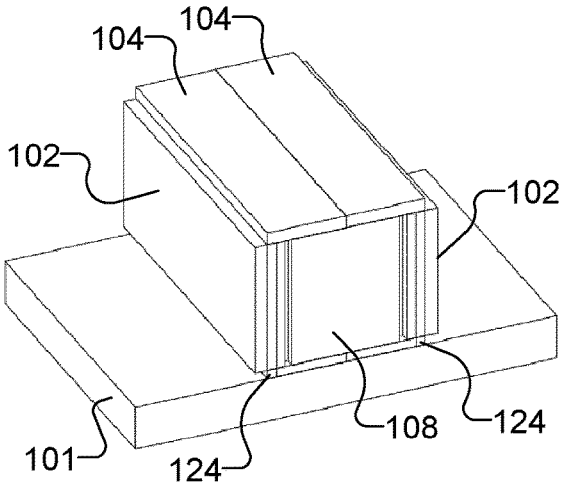
Figure 3K:
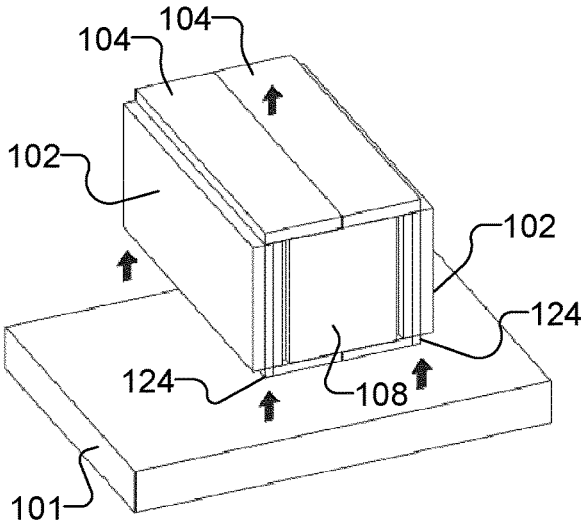

Finally, as shown in FIGS. 3G and 3H, lateral roof panels 102 can be folded inwardly and downwardly relative to the central roof panels 104 to which they are hingedly connected until lateral roof panels 102 extend perpendicularly to central roof panels 104, as shown in FIG. 3I, and lateral support beams 124 can be moved into position against the outer lateral edges of central floor panels 106 beneath lateral floor panels 120 and secured in place in any suitable manner for transport, as shown in FIGS. 3J and 3K. In this manner, lateral support beams 124 can assist in vertically supporting lateral floor panels 120 during transport, to minimize any forces acting thereon and potentially loosening components of modular building structure 100, although the person skilled in the art will appreciate this could be omitted if desired for any reason, or alternative mechanisms could be used to support the components of modular building structure 100 during transport in alternative embodiments. Similarly, if desired additional supporting beams could be positioned beneath lateral roof panels 102 to support lateral roof panels 102 during transport. The components of modular building structure 100 can also be secured together in any suitable fashion for transport; for example nails or screws may be used at strategic locations to secure various components of the modular building structure 100 together to minimize vibration or relative movement of components during transport, e.g. by using nails or screws or the like.

With reference to FIGS. 4A-4L, an example method of unfolding modular building structure 100 to its deployed configuration is illustrated. In FIGS. 4A-4L, supporting frame 110 has again not been illustrated for clarity, but the person skilled in the art would be able to deploy supporting frame 110 in a similar manner as illustrated in FIGS. 2A-2Q in order to support the fully deployed configuration of modular building structure 100. For example in the illustrated embodiment, outwardly extending supports 118 would be secured back into position during deployment to support lateral roof panels 102.

Figure 4A:
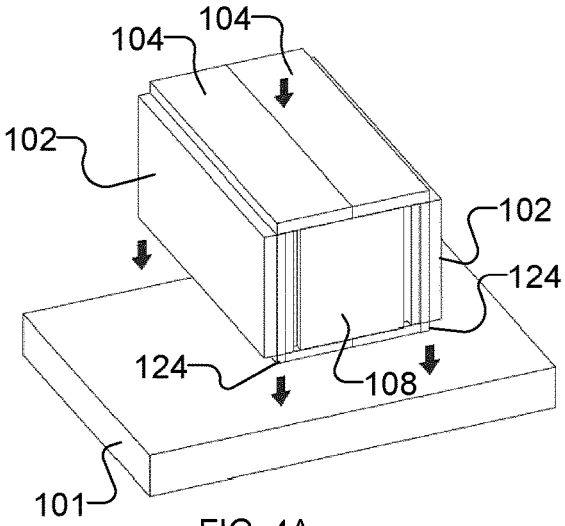
FIGS. 4A-4L show various stages in the unfolding of an example embodiment of a modular building structure, e.g. subsequent to transport and for deployment at an installation site.
Figure 4B:
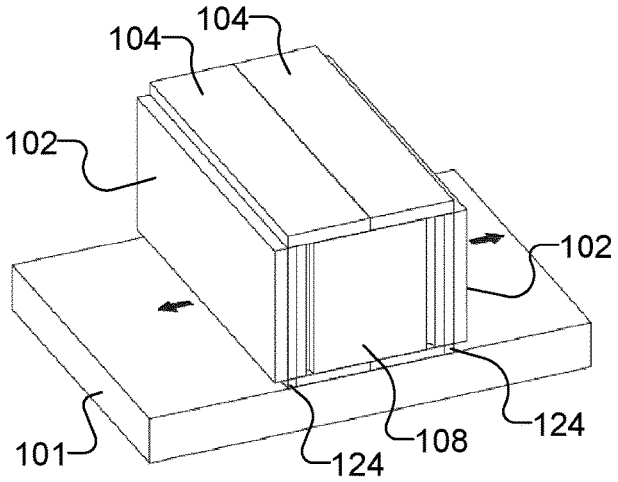
Figure 4C:
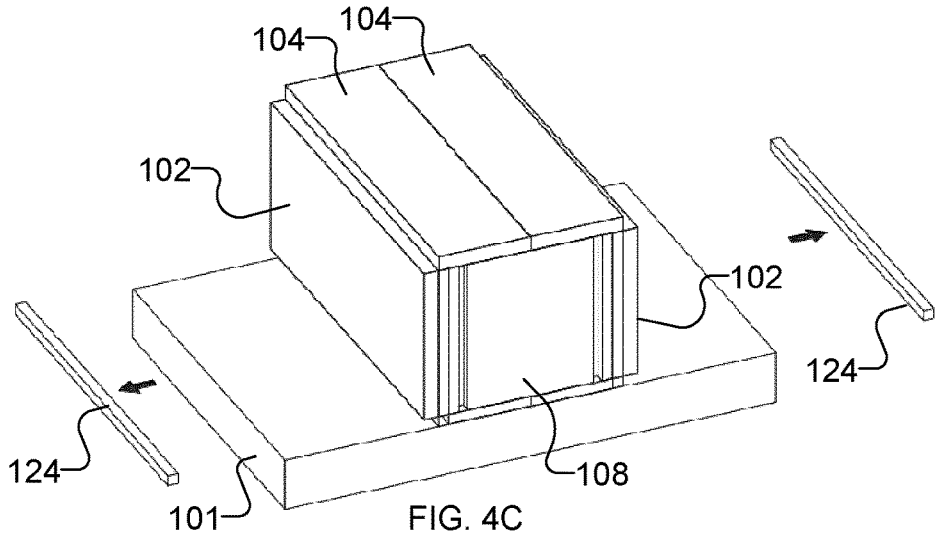

As shown in FIG. 4A, the folded modular building structure 100 is first positioned on its foundation 101. As shown in FIGS. 4B and 4C, lateral support beams 124 are removed from their storage position against central floor panels 106 to allow unfolding to occur unimpeded.

Figure 4D:
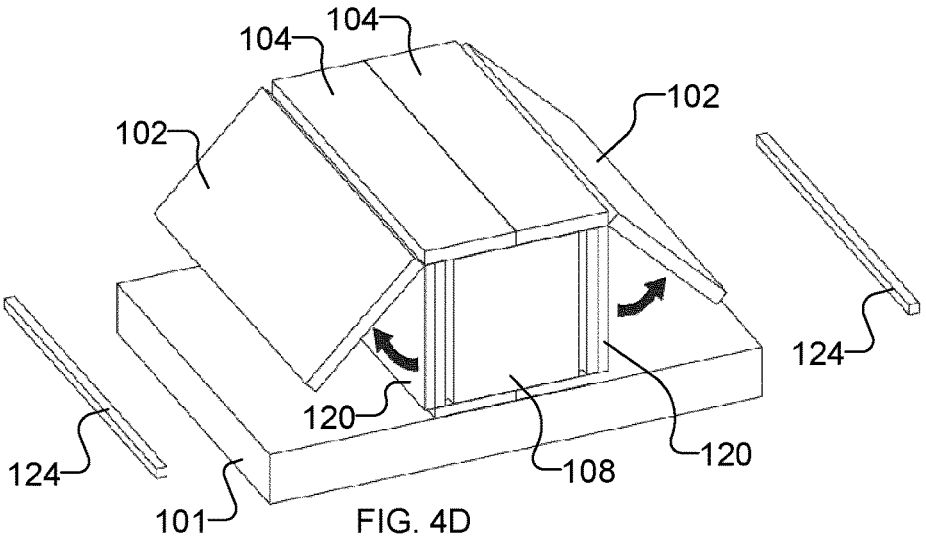
Figure 4E:
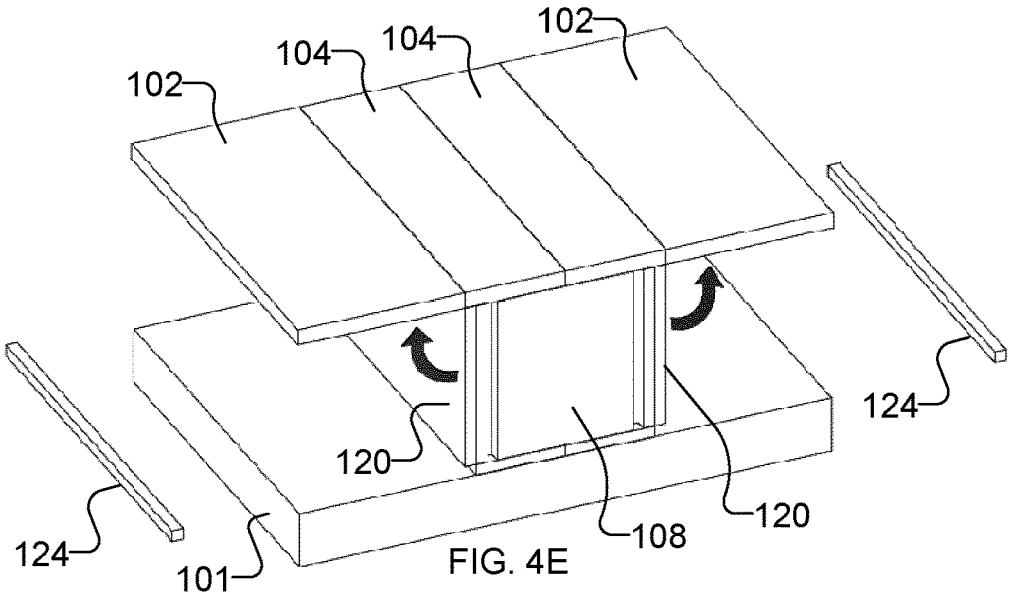

With reference to FIGS. 4D and 4E, the first unfolding step in deploying modular building structure 100 is to upwardly rotate lateral roof panels 102 relative to their hinged connection to central roof panels 104, so that lateral roof panels 102 are brought into a parallel position relative to and in the same plane as central roof panels 104. After roof panels 102 have been moved to their deployed configuration, outwardly extending supports 118 can be reassembled with the remainder of supporting frame 110.

Figure 4F:
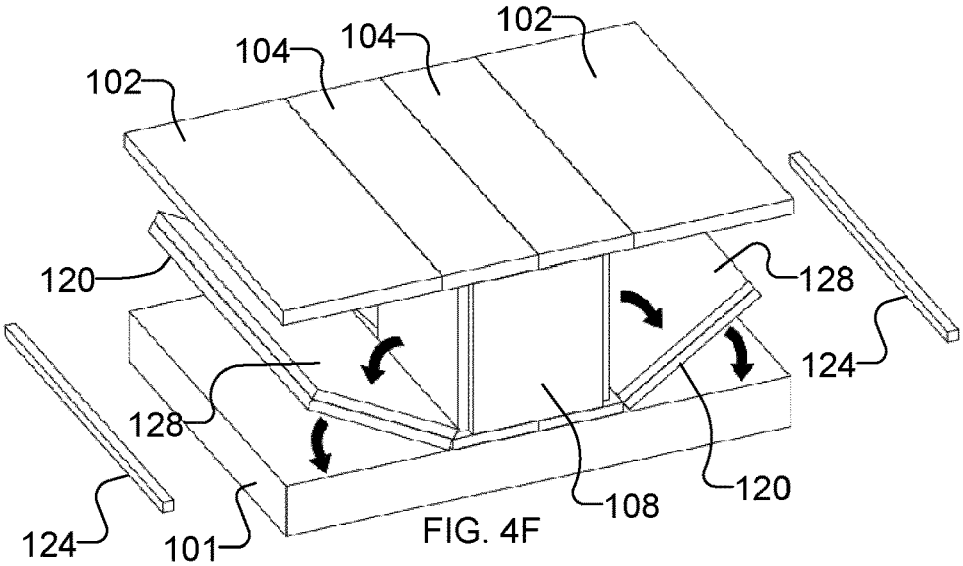

With reference to FIG. 4F, the structural unit formed by outside lateral sidewalls 128 and lateral floor panels 120 can be rotated outwardly and downwardly relative to central floor panels 106 to which lateral floor panels 120 are hingedly connected so that lateral floor panels 120 are brought into parallel alignment with central floor panels 106 (i.e. so that lateral floor panels 120 extend parallel to and in the same plane as central floor panels 106).

Figure 4G:
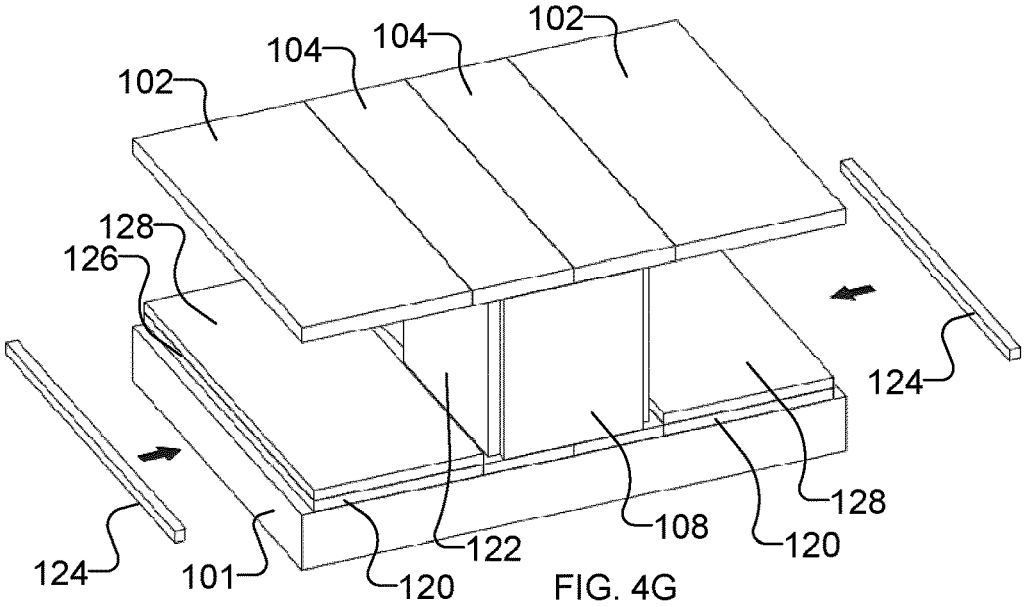
Figure 4H:
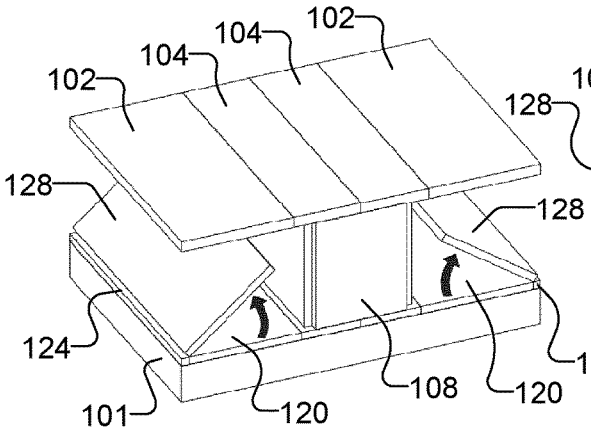
Figure 4I:
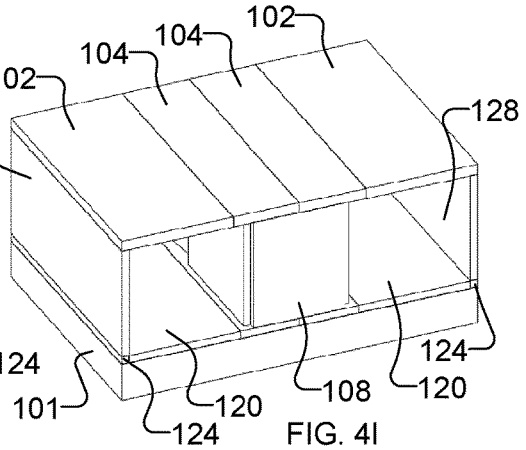

As shown in FIG. 4G, lateral support beams 124 can be brought into position adjacent the outer lateral edges 126 of lateral floor panels 120, so that as shown in FIG. 4H, outer lateral sidewalls 128 can be rotated upwardly and outwardly relative to the edge of lateral floor panels 120 to which they are hingedly connected to move the outer lateral sidewalls 128 to their deployed configuration extending perpendicularly between and interposing lateral roof panels 102 and lateral floor panels 120 and lateral support beams 124 interposing outer lateral sidewalls 128 and foundation 101 as shown in FIG. 4I.

Figure 4J:
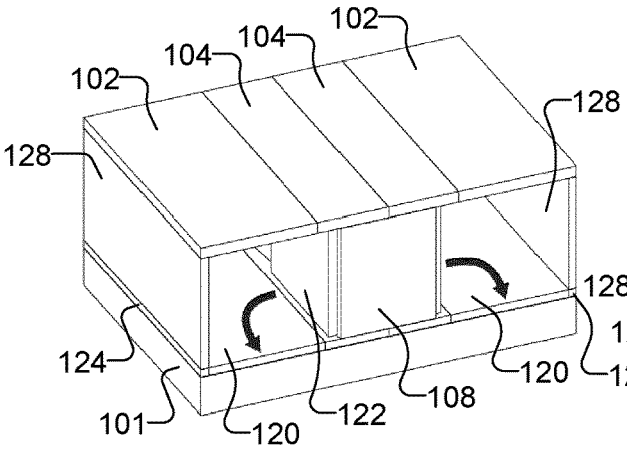
Figure 4K:
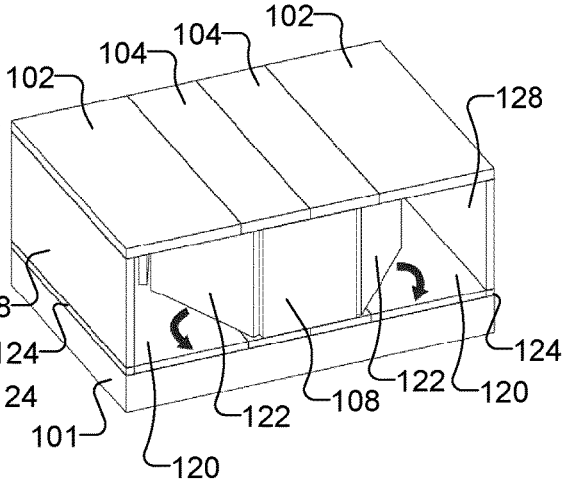
Figure 4L:
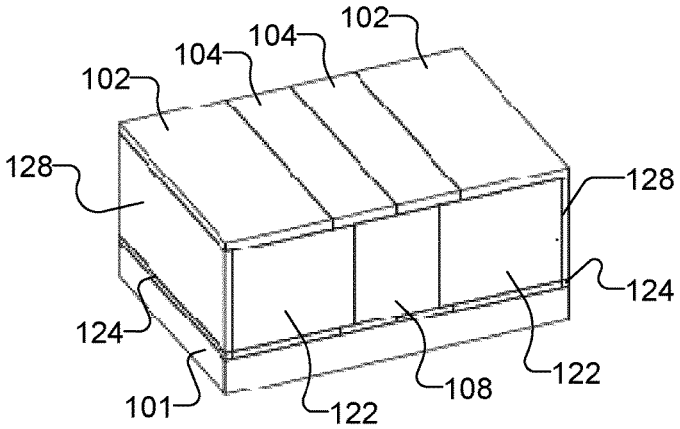

With reference to FIGS. 4J and 4K, each one of outside wall panels 122 can then be rotated horizontally outwardly relative to the edge of the central sidewall 108 to which the outside wall panel 122 is connected until each outside wall panel is brought to its deployed configuration in parallel alignment with the central sidewall 108 to which the outside wall panel 122 is connected as shown in FIG. 4L (i.e. the outside wall panel 122 extends parallel to and in the same plane as central sidewall 108).

Figure 5A:
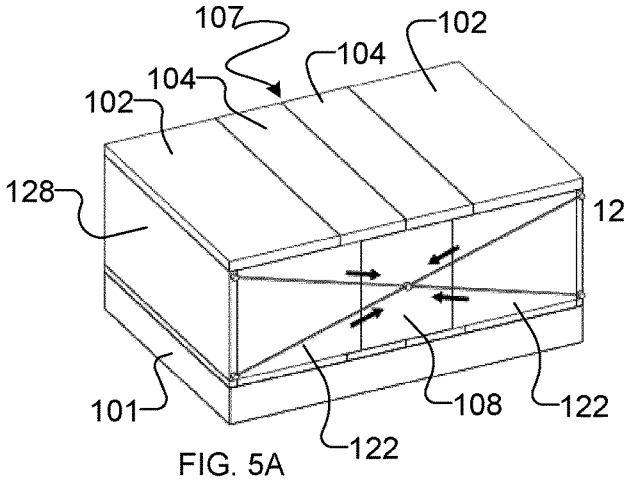
FIGS. 5A-5F show various stages in the tightening down of a modular building structure as part of the deployment thereof.
Figure 5B:
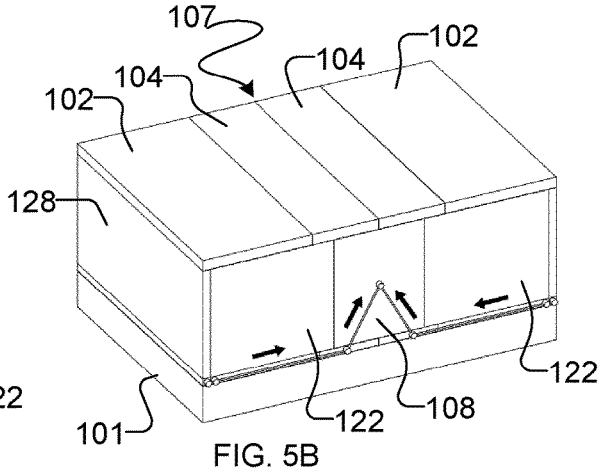
Figure 5C:
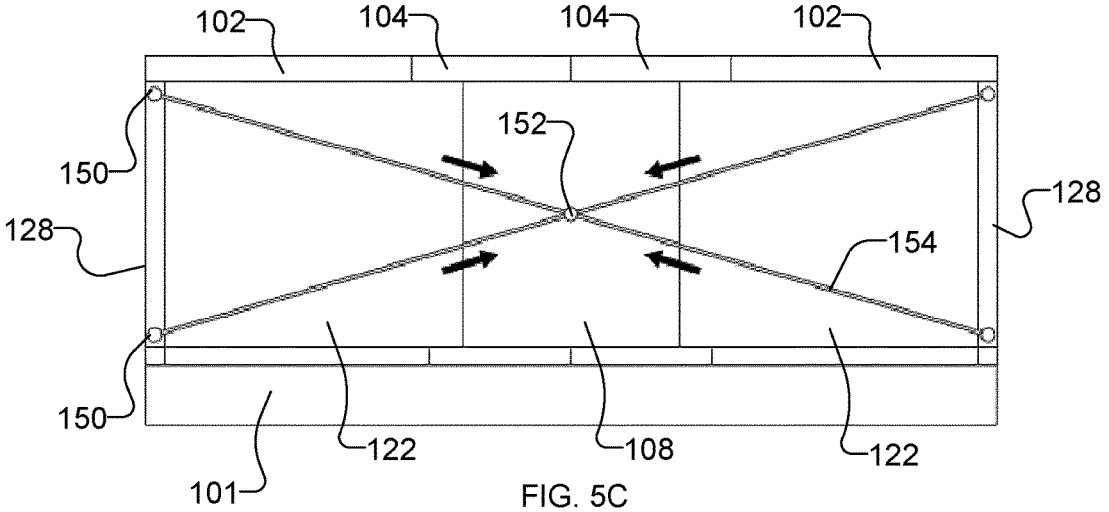

With reference to FIGS. 5A-5F, in some embodiments after modular building structure 100 has been unfolded, components thereof are tightened together with tensioning cables. With reference to FIG. 5A and FIG. 5C, in some embodiments, outside lateral sidewalls 128 are tightened inwardly towards the central core provided by fixed portion 107. In the illustrated embodiment, this is achieved by providing a pair of lateral sidewall tensioning connection points 150, one proximate to each of the upper and lower edges of outside lateral sidewall 128, on both the front and rear faces of modular building structure 100. In this way, a lateral sidewall tensioning connection point 150 is provided on outside lateral sidewall 128 at or approximately at each corner of the front and rear faces of modular building structure 100 for tightening.

A central tensioning connection point 152 is provided proximate a centrepoint of each one of central sidewalls 108 (i.e. on both the front and rear faces of the modular building structure 100) Tensioning cables 154 are used to connect each one of lateral sidewall tensioning connection points 150 to central tensioning connection point 152 so that outside lateral sidewalls 128 can be pulled inwardly towards the central core provided by fixed portion 107 via the application of tension to tensioning cables 154 in any suitable manner. In one example embodiment, a winch or other suitable tensioning member can be provided at each one of the tensioning connection points to facilitate the application of tension to tensioning cables 154.

Figure 5D:
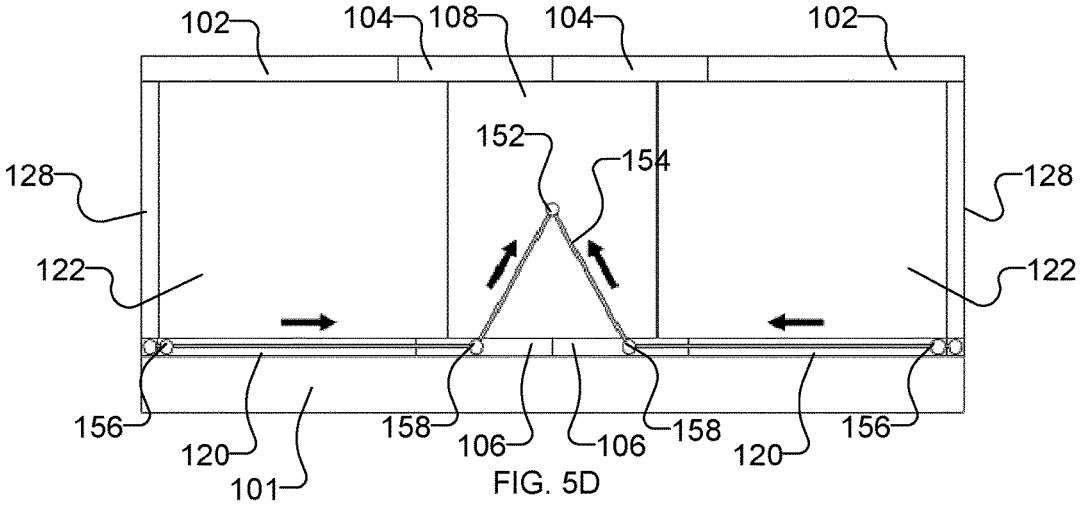

With reference to FIGS. 5B and 5D, in some embodiments, the lateral floor panels 120 are tightened inwardly towards central floor panels 106. In the illustrated embodiment, this is achieved by providing a pair of lateral floor panel tensioning connection points 156 on the front and rear edges of each one of lateral floor panels 120. A corresponding pair of central floor panel tensioning connection points 158 are provided on each one of central floor panels 106 (i.e. on each of the front and rear faces of modular building assembly 100), and lateral floor panel tensioning connection points 156 are connected first to central floor panel tensioning connection points 158 and then to central tensioning connection point 152 via tensioning cables 154 so that lateral floor panels 120 can be pulled inwardly towards central floor panels 106 via the application of tension to tensioning cables 154 in any suitable manner. In one example embodiment, a winch or other suitable tensioning member can be provided at each one of the tensioning connection points to facilitate the application of tension to tensioning cables 154.

Figure 5E:
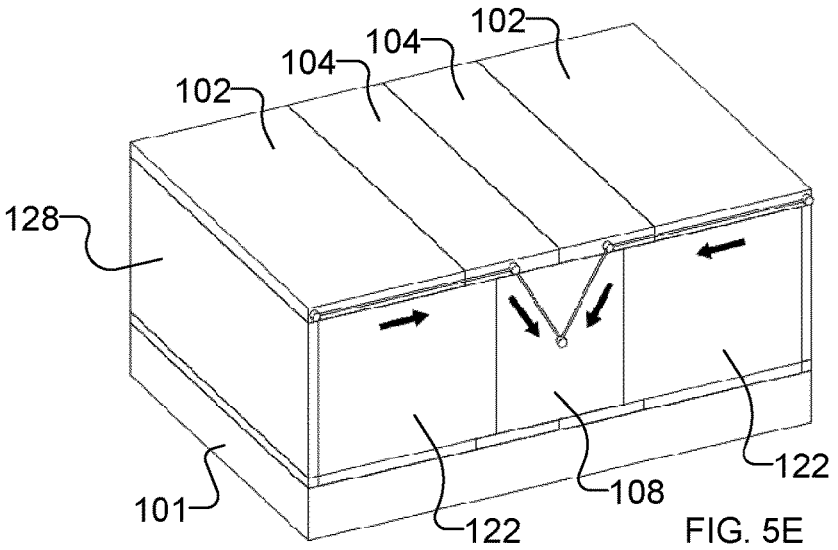
Figure 5F:
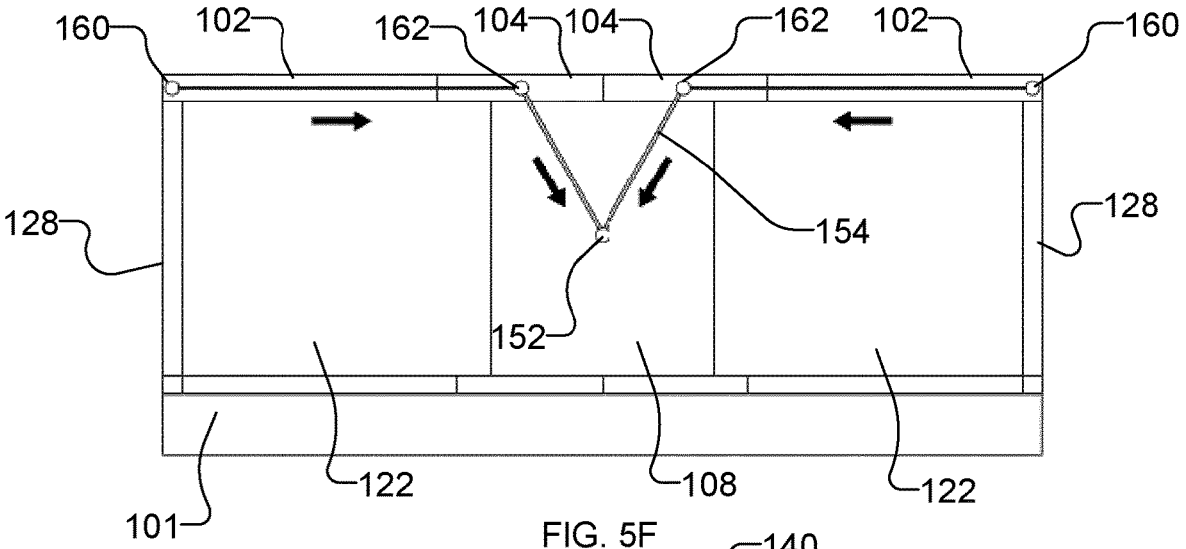

With reference to FIGS. 5E and 5F, in some embodiments, the lateral roof panels 102 are tightened inwardly towards central roof panels 104. In the illustrated embodiment, this is achieved by providing a pair of lateral roof panel tensioning connection points 160 on the front and rear edges of each one of roof floor panels 102. A corresponding pair of central roof panel tensioning connection points 162 are provided on each one of central roof panels 104, and lateral roof panel tensioning connection points 160 are connected first to central roof panel tensioning connection points 162 and then to central tensioning connection point 152 via tensioning cables 154 so that lateral roof panels 102 can be pulled inwardly towards central roof panels 104 via the application of tension to tensioning cables 154 in any suitable manner. In one example embodiment, a winch or other suitable tensioning member can be provided at each one of the tensioning connection points to facilitate the application of tension to tensioning cables 154. In alternative embodiments, tensioning cables 154 can be run through or around each tensioning connection point, and a winch provided at one of the points or at a separate point no the tensioning cable 154 can be used to tension tensioning cables 154.

In some embodiments, the tensioning steps described above are carried out on both the front face and the rear face of modular building structure 100.

While the various tensioning connection points have been described herein as having a position as illustrated in FIGS.

5A-5F, in alternative embodiments, any location for such connection points that allows the tension to be applied between two or more components of modular building structure 100 in the desired direction can be used.

Once the desired tightening of components of modular building assembly 100 has been completed, the tensioning cables and any tensioning members (e.g. winches) that were used may be removed.

In some embodiments, as part of a quality control effort and/or to ensure that the various components of modular building structure 100 will fit together without undesirable gaps, tensioning as described above can also be carried out during the assembly of modular building structure 100, prior to the structure being folded and transported for delivery.

Once modular building structure 100 has been placed in its final configuration and any desired tightening has been carried out, the various components of modular building structure 100 can be secured into place in any desired manner to retain modular building structure 100 in its deployed configuration. For example, various fasteners such as nails, screws, SIP screws, LTP5s, or the like can be used to secure the components of modular building structure 100 into position. Any desired exterior finishing (e.g. siding) and a protective roof can be added after modular building structure 100 has been deployed.

Figure 6:
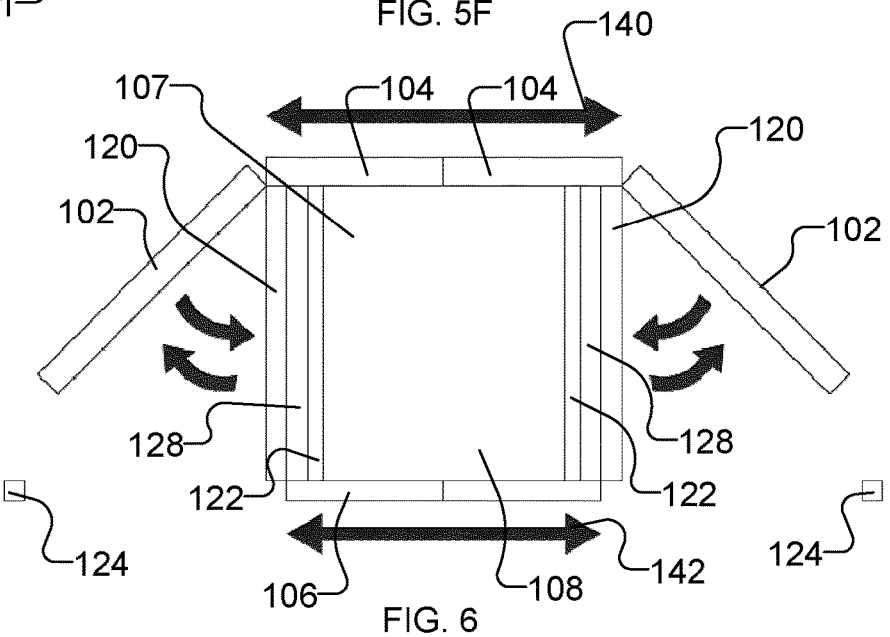
FIG. 6 shows an end view of an example embodiment of a modular building structure.

As shown in FIG. 6, in the illustrated embodiment of modular building structure 100, as lateral roof panels 102 are folded inwardly and downwardly relative to central roof panels 104 in the folded configuration, central roof panel 103 (comprised of central roof panels 104 in the illustrated embodiment) has a width 140 that is greater than a width 142 of central floor panel 105 (comprised of central floor panels 106 in the illustrated embodiment). In some embodiments, width 140 is greater than width 142 by an amount that corresponds to a thickness of the lateral floor panels.

Further, outside wall panels 122 are positioned slightly inwardly of the outer lateral edges of central floor panels 106, so that in the folded configuration, there is room for a thickness of outer lateral sidewalls 128 to be received above and vertically supported by the outer edge of central floor panel 106. Thus, central sidewalls 108 have a width that is slightly less than the width of central floor panel 106.

As can be seen in FIG. 6, in the folded configuration, outside wall panels 122 are folded into position against fixed portion 107, with outer lateral sidewalls 128 interposing outside wall panels 122 and lateral floor panels 120. Lateral support beams 124 can be fixed into position against central floor panels 106 to provide vertical support to lateral floor panels 120 during transport.

The folding and unfolding of modular building structure 100 can be carried out in any suitable manner, for example by using human or automated means and/or including using various temporary supports of any type (including using e.g. pieces of lumber or other structural members to prop components of the modular building structure into position). In some embodiments, as illustrated in FIGS. 7A-7I, a supporting cable or winch system is used to assist in moving and/or supporting the various components of modular building structure 100 from their folded to their deployed positions.

Figure 7A:
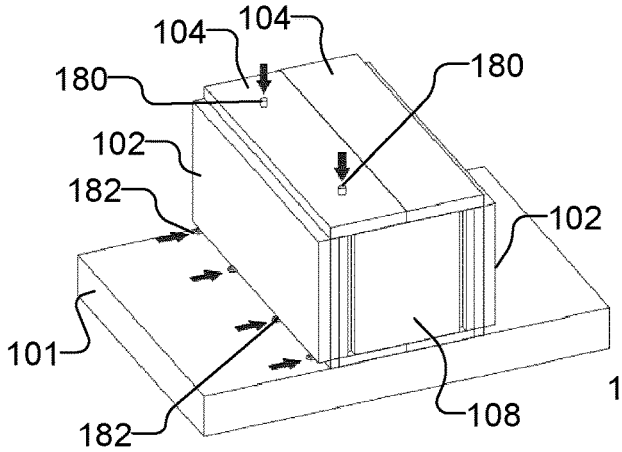
FIGS. 7A-7I illustrate an example embodiment of a winch system that can be used to assist in the deployment of a modular building structure.

With reference to FIG. 7A, when modular building structure 100 is in its folded configuration, one or more central roof cable connection points 180 can be secured to the upper surface of central roof panel 104. One or more lateral roof cable connection points 182 can be secured to lateral roof panel 102. In the illustrated embodiment, lateral roof cable connection points 182 are secured to the outer lateral edge of lateral roof panel 102, to maximize the leverage applied to hoist lateral roof panel 102 into its deployed position by cable 184. However, in other embodiments, other connection points on lateral roof panel 102 could be used. To apply relatively even force to lateral roof panel 102, in the illustrated embodiment, two central roof cable connection points 180 and four lateral roof cable connection points 182 are provided. However, in other embodiments, more or fewer roof cable connection points 180 and/or lateral roof cable connection points 182 could independently be provided.

Figure 7B:
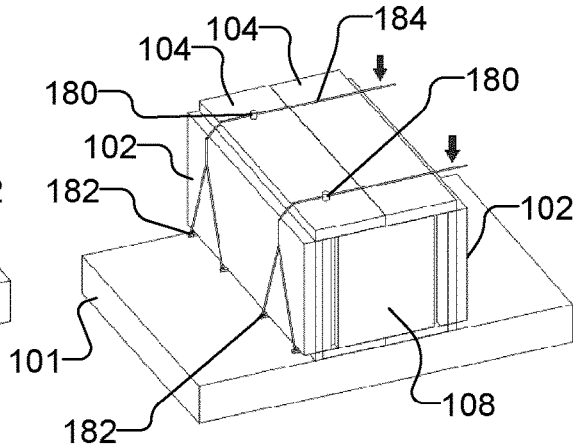
Figure 7C:
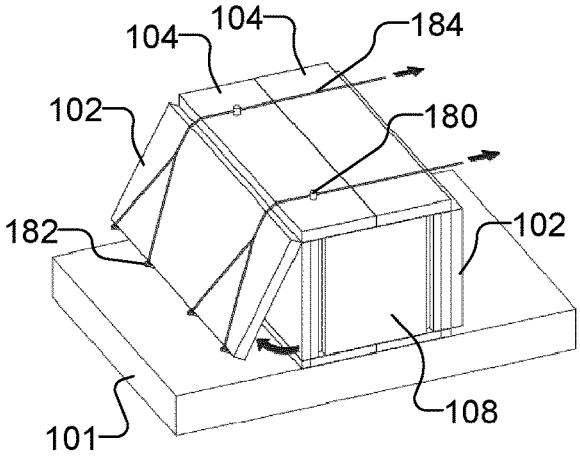
Figure 7D:
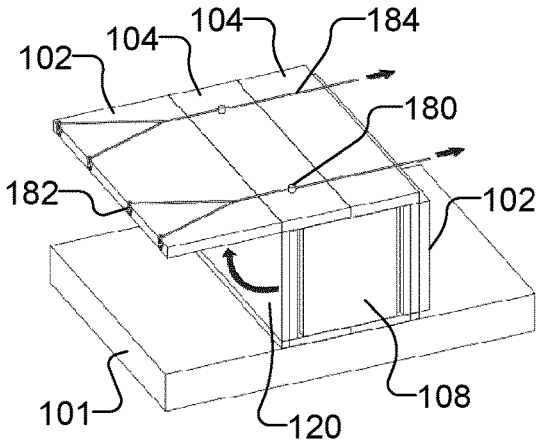
Figure 7E:
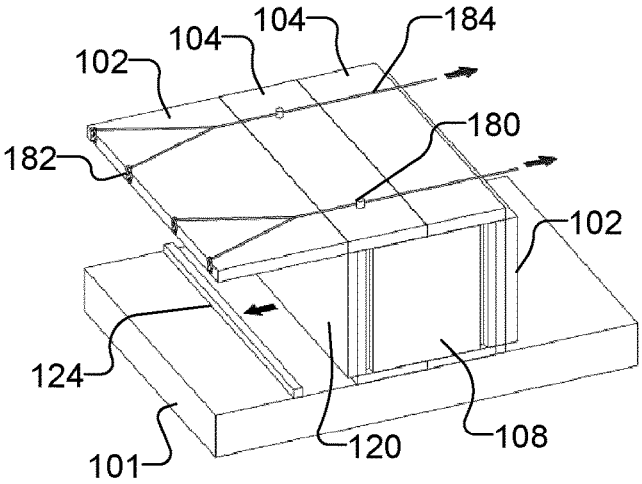
Figure 7F:
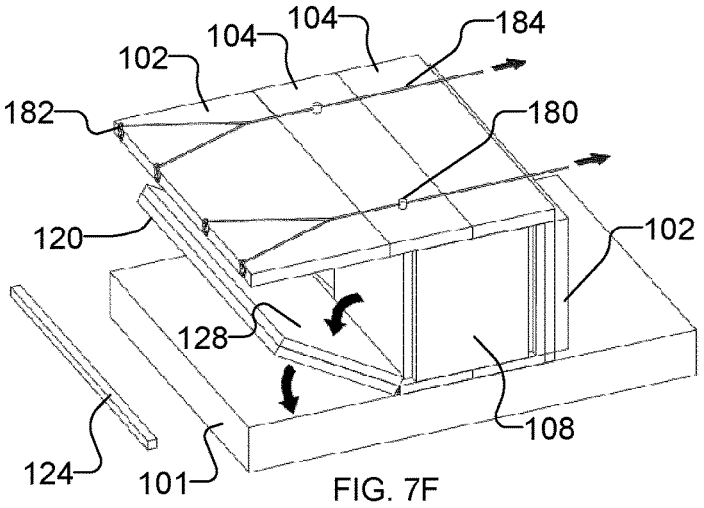
Figure 7G:
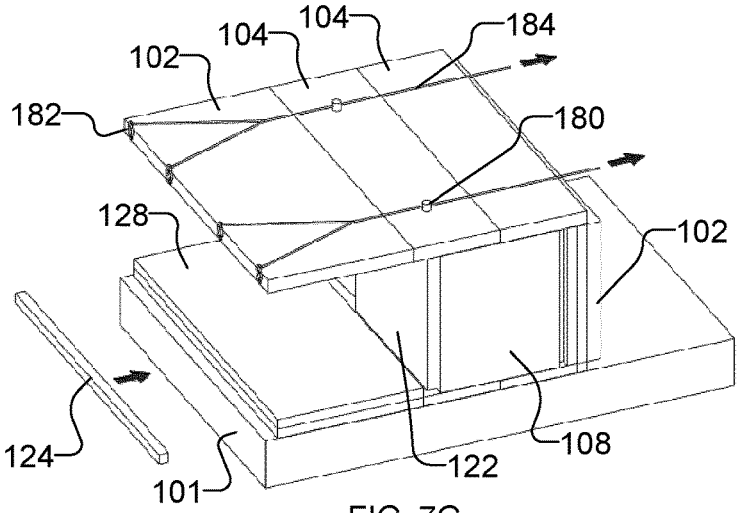
Figure 7H:
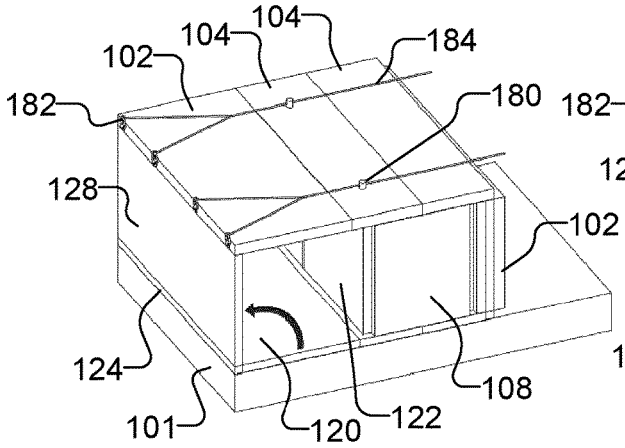
Figure 7I:
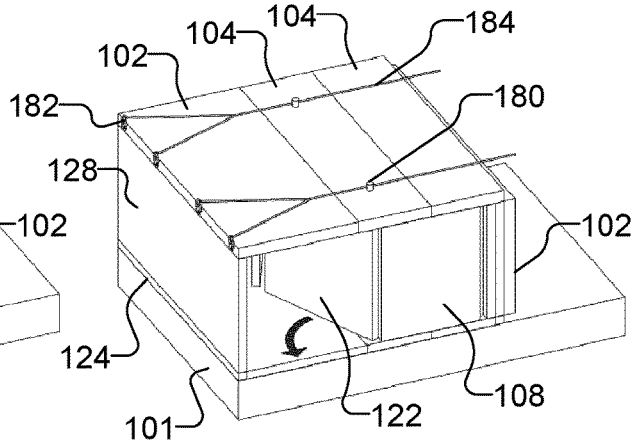
Figure 8A:
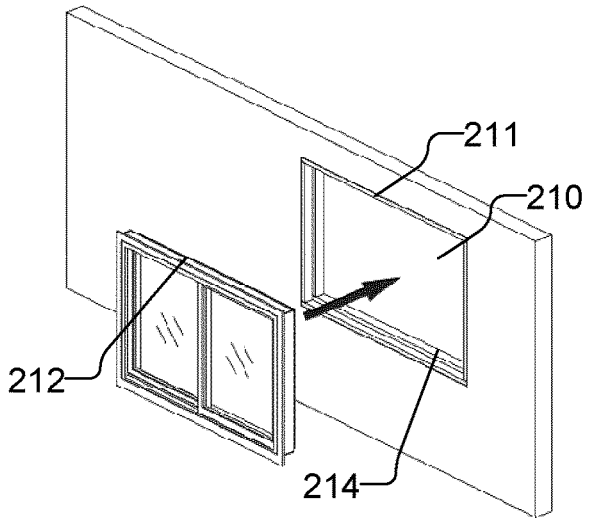
FIGS. 8A-8D show an example embodiment of a flush mount window.
Figure 8B:
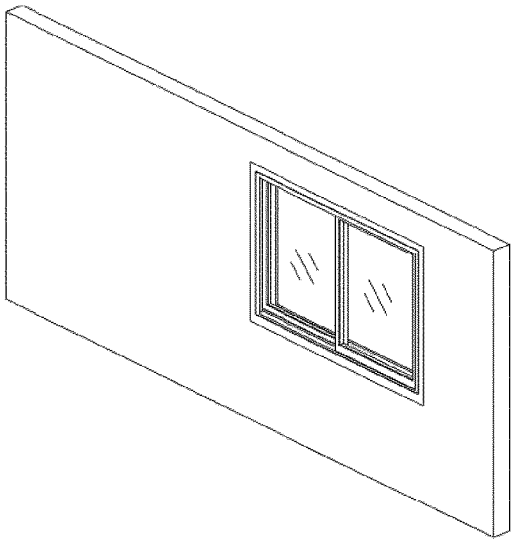
Figure 8C:
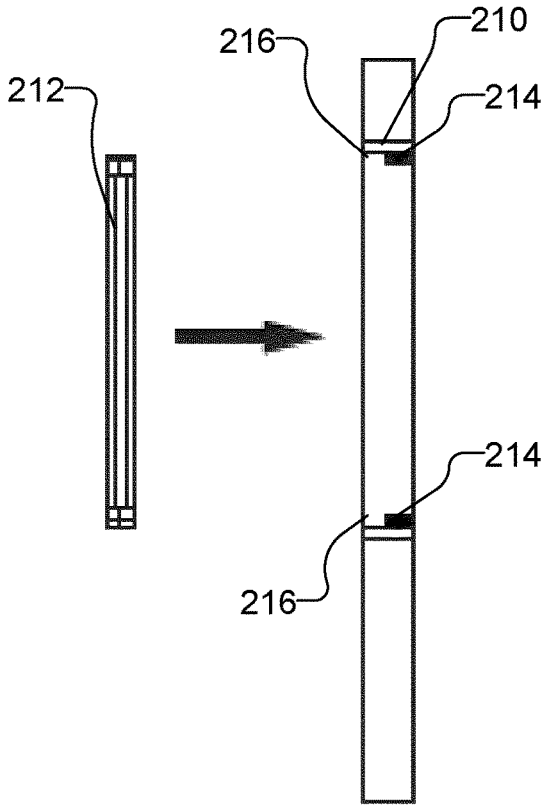
Figure 8D:
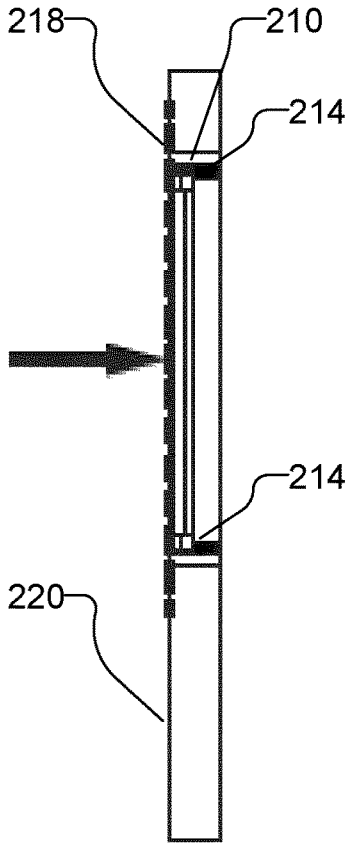

With reference to FIGS. 7B and 7C, once cable 184 has been secured into position at lateral roof cable connection points 182 and run through or around central roof cable connection points 180, a pulling force can be applied to cable 184 in a direction away from central roof cable connection points 180 in any suitable manner, for example by using appropriate winches or the like, to hoist the outside lateral edge of lateral roof panel 102 towards its deployed position in which it is parallel to and sits in the same plane as central roof panel 104, as shown in FIG. 7D.

With reference to FIGS. 7E, 7F, 7G, 7H and 7I, a pulling force can be maintained on cable 184 in a direction away from central roof cable connection points 180 to retain or to help retain lateral roof panels 102 in their deployed position during the deployment of the remaining portions of modular building structure 100. Subsequent to securing lateral roof panel 102 in its deployed position, cable 184, lateral roof cable connection points 182 and central roof cable connection points 180 can be removed.

With reference to FIGS. 8A-8D, in some embodiments in order to facilitate the flat folding of modular building structure 100 while allowing windows to be pre-installed during the assembly of modular building structure 100 (i.e. as opposed to being installed during the deployment of modular building structure 100 at its desired deployment location), recessed windows are used.

To facilitate the installation of recessed windows, the window opening 210 in the respective panel that is to contain the window 212 is lined with an appropriate supporting material to provide a frame 214 inset within the perimeter 211 of window opening 210. Any suitable material can be used to provide frame 214, including wood, bamboo, metal (including steel), polymers, plastic or other suitable natural or synthetic materials; or a cut portion of structural insulated panel, cross-laminated timber (CLT), or any panelized wall system now existing or developed in future, or the like.

Frame 214 helps to define together with the inner perimeter 211 of window opening 210 a recess 216 within window opening 210 into which window 212 can be inserted. Window 212 can be secured in place against frame 214 in any suitable manner, so that window 212 then sits flush with the outer surface 220 of the panel into which window opening 210 is provided, as indicated by dashed line 218.

Figure 9A:
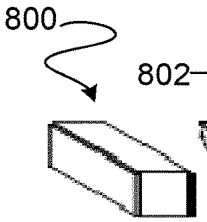
FIGS. 9A-9E show an example method for unfolding an example embodiment of a modular building structure.
Figure 9B:
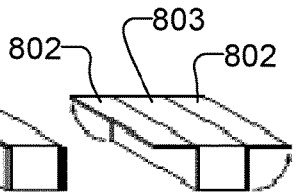

FIGS. 9A-9E illustrate an example embodiment of a method of unfolding a further example embodiment of a modular building structure 800. Elements of modular building structure 800 that are similar to elements of modular building structure 100 are represented with reference numerals incremented by 700. FIG. 9A shows modular building structure 800 in its folded configuration. FIG. 9B shows the rotating of lateral roof panels 802 relative to central roof panel 803 outwardly and upwardly. Lateral roof panels 802 are hingedly coupled to the outer lateral edges of central roof panel 803 to facilitate such unfolding.

Figure 9C:
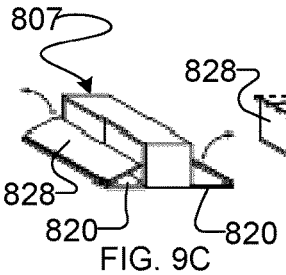
Figure 9D:
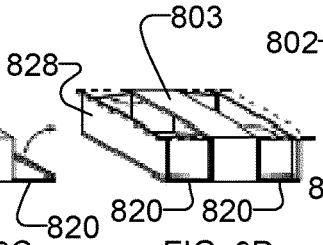
Figure 9E:
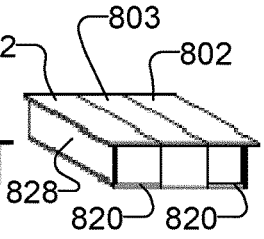

FIG. 9C omits the lateral roof panels 802 for clarity and shows the unfolding of both lateral floor panels 820 and outer lateral sidewalls 828 by rotation outwardly and downwardly from fixed portion 807, followed by continued rotation outwardly and upwardly of outer lateral sidewalls 828 until outer lateral sidewalls 828 are oriented perpendicularly to lateral roof panels 802 and interpose lateral roof panels 802 and lateral floor panels 820 to yield the final deployed configuration of modular building structure 800 as shown in FIGS. 9D (with lateral roof panels 802 shown in phantom for clarity) and 9E.

Figure 10A:
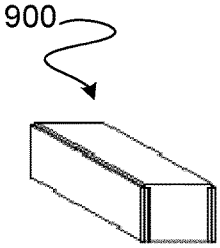
FIGS. 10A-10P show an example method for unfolding an example embodiment of a modular building structure.
Figure 10B:
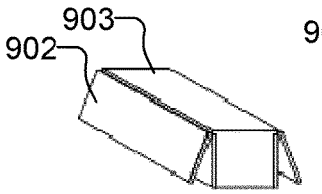
Figure 10C:
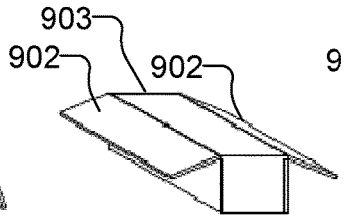
Figure 10D:
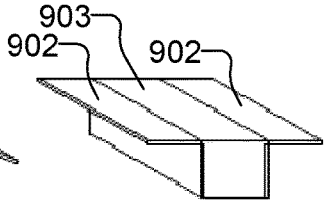
Figure 10E:
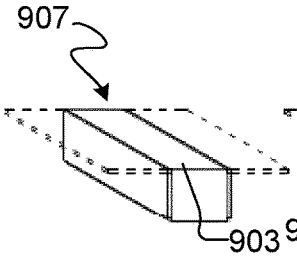
Figure 10F:
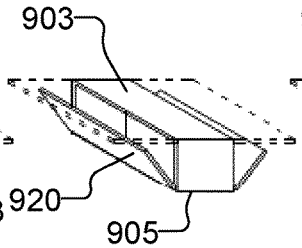
Figure 10G:
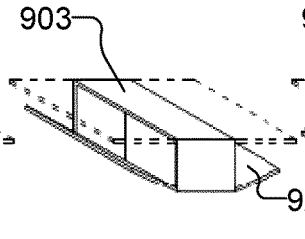
Figure 10H:
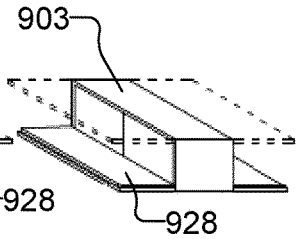
Figure 10I:
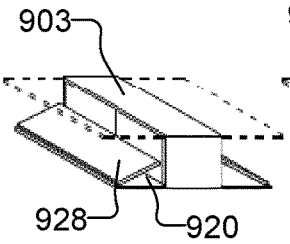
Figure 10J:
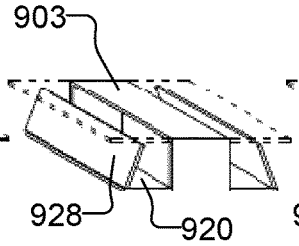
Figure 10K:
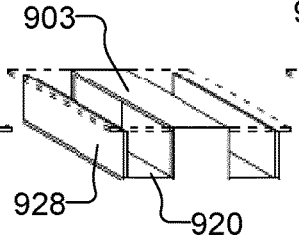
Figure 10L:
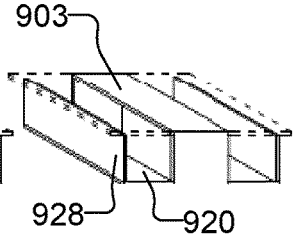
Figure 10M:
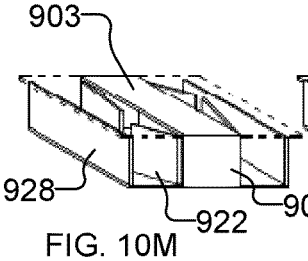
Figure 10N:
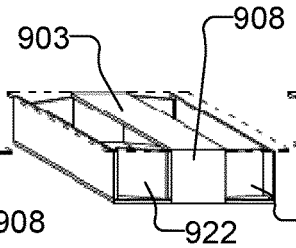
Figure 10O:
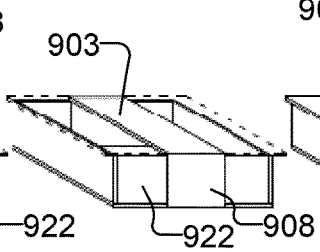
Figure 10P:
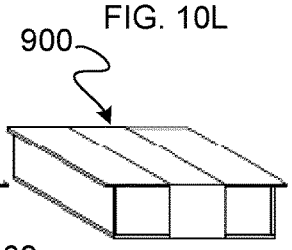

A further exemplary embodiment of a method of unfolding a further example embodiment of a modular building structure 900 is illustrated in FIGS. 10A-10P. Elements of modular building structure 900 that are similar to elements of modular building structure 100 are represented with reference numerals incremented by 800.

FIG. 10A shows modular building structure 900 in its folded configuration. FIGS. 10B and 10C show the rotating of lateral roof panels 902 relative to central roof panel 903 outwardly and upwardly. Lateral roof panels 902 are hingedly coupled to the outer lateral edges of central roof panel 903 to facilitate such unfolding. FIGS. 10D and 10E show the lateral roof panels 902 in their deployed position, parallel to and extending in the same plane as central roof panel 903.

FIGS. 10E-100 show lateral roof panels 902 in phantom for clarity. FIGS. 10F and 10G show the unfolding of the lateral floor panels 920 and outside lateral sidewalls 928 as a unit outwardly and downwardly relative to fixed portion 907 via the hinged connection between lateral floor panels 920 and central floor panel 905, until lateral floor panels 920 reach their deployed position, parallel to and extending in the same plane as central floor panel 905, as shown in FIG. 10H.

FIGS. 10I and 10J show the unfolding of outside lateral sidewalls 928 outwardly and upwardly relative to lateral floor panels 920 via the hinged connection between the outer lateral edges of the lateral floor panels 920 and the bottom edge of outside lateral sidewalls 928. FIGS. 10K and 10L show outside lateral sidewalls 928 in their deployed position, extending perpendicularly between and interposing lateral floor panels 920 and lateral roof panels 902.

FIGS. 10M and 10N show the horizontally outward rotation of outside wall panels 922 relative to central sidewalls 908 to their deployed position extending parallel to and in the same plane as central sidewalls 908, as shown in FIG. 100. FIG. 10P shows the overall modular building structure 900 in its deployed configuration.

FIGS. 11A-11E and 12A-12E illustrate example methods and configurations of placing service walls 170 in a variety of possible configurations in the modular building structure, if need be, that contain services such as, but not limited to, mechanical, electrical and plumbing. In the illustrated embodiment, the service walls are placed within fixed portion 107, so that the services can be installed in the factory or other location where modular building structure 100 is being assembled, so that such services do not have to be installed in the field during deployment of modular building structure 100. In some embodiments, interior finishes of modular building structure 100 such as drywall are similarly installed during assembly of modular building structure 100 so that these do not need to be separately installed in the field during deployment.

In some embodiments, fixed portion 107 can include additional features such as a processing unit, communications modules, wireless interface or the like that can allow modular building structure 100 to act as a smart home. For example, various components of the services contained within service walls can include sensors that report on the operation of those services. In the event of a failure of such service the sensor can provide a signal to the processing unit, which can optionally notify an occupant that the service needs attention, or which can optionally utilize the communications module to send a report to a remote location (such as the manufacturer or installer of the modular building structure), to notify them that maintenance may be required.

In some embodiments, as illustrated as modular building structure 1100 in FIGS. 13A-13F and 14A-14F, alternative configurations can be used to provide the roof of the modular building structure. Components of modular building structure 1100 which correspond to components of modular building structure 100 are described with reference numerals incremented by 1000.

Figure 13A:
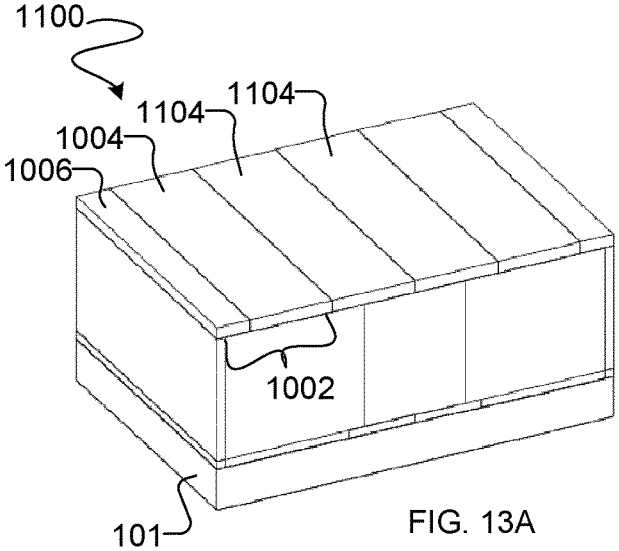
FIGS. 13A-13E illustrate an example method for folding an example embodiment of a modular building structure in which the lateral roof panels rotate upwardly relative to the central roof panel.
Figure 13B:
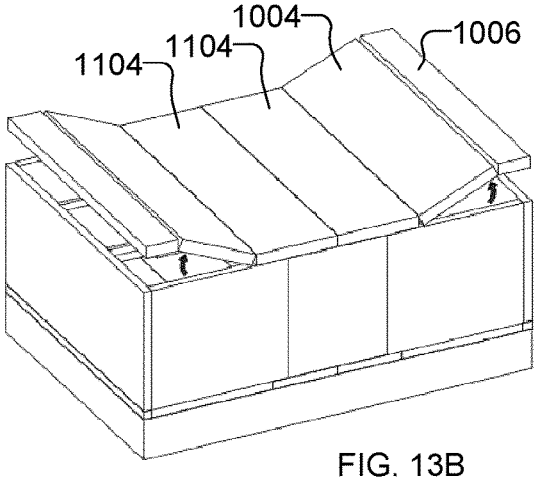
Figure 13C:
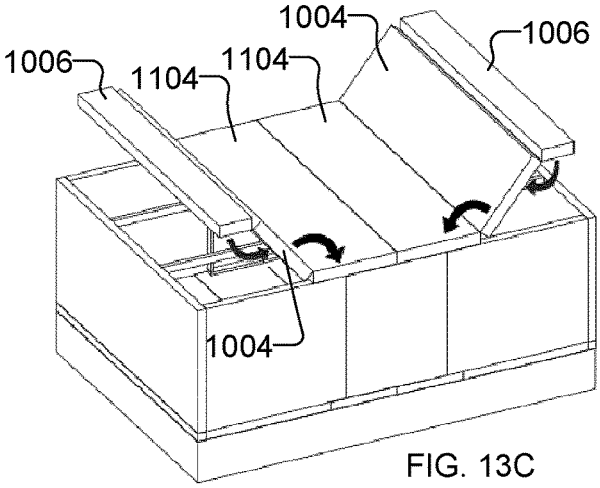
Figure 13D:
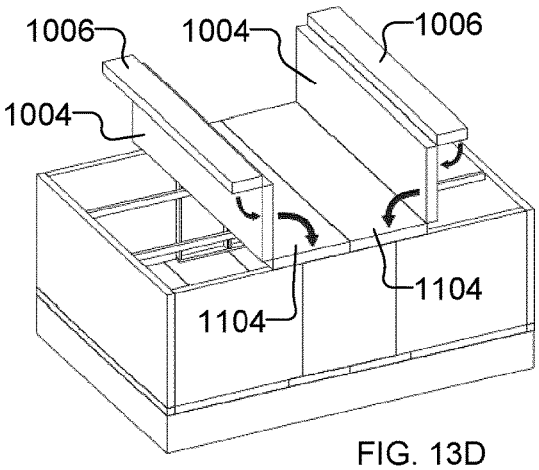
Figure 13E:
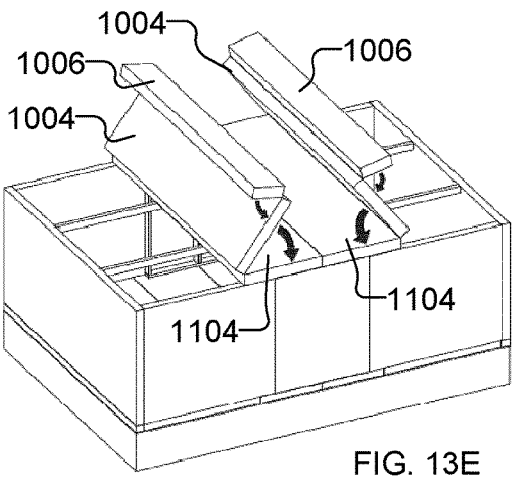
Figure 13F:
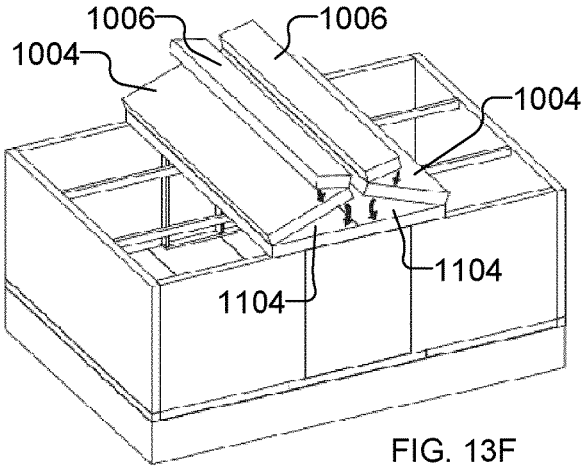
Figure 14A:
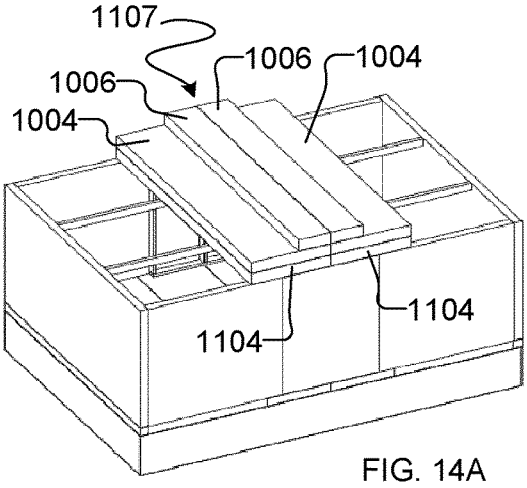
FIGS. 14A-14E illustrate an example method for deploying an example embodiment of a modular building structure in which the lateral roof panels rotate upwardly relative to the central roof panel.
Figure 14B:
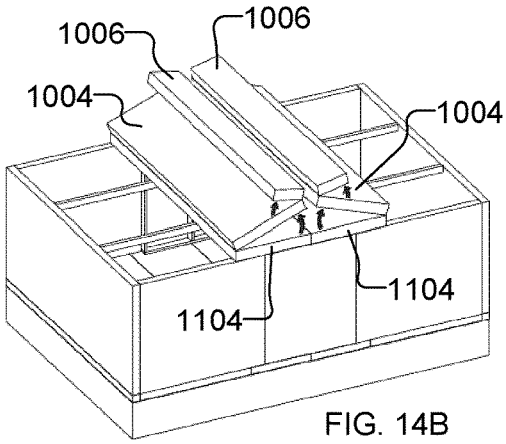
Figure 14C:
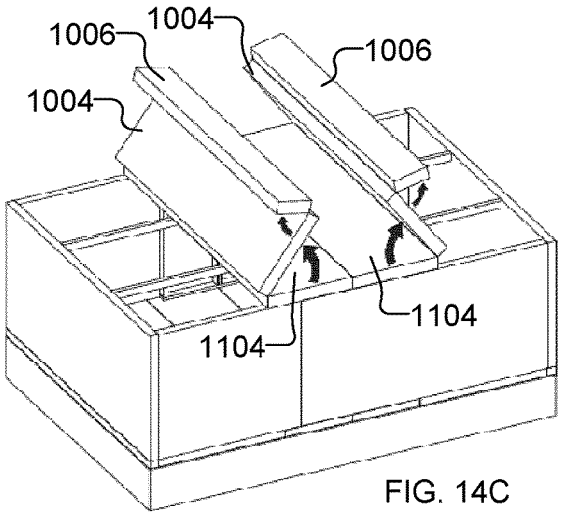
Figure 14D:
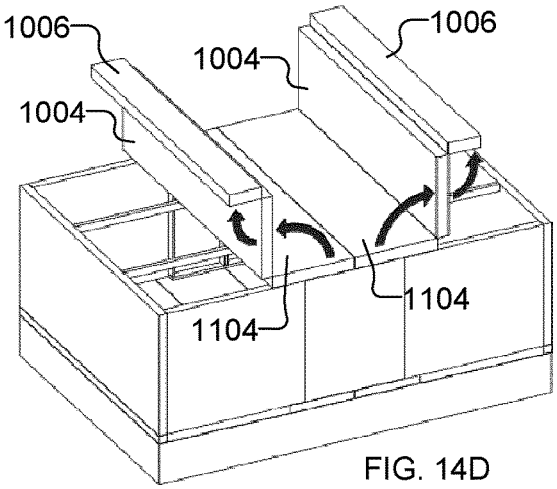
Figure 14E:
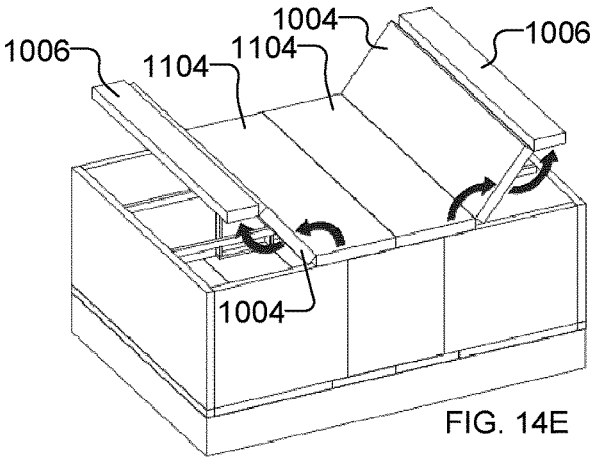
Figure 14F:
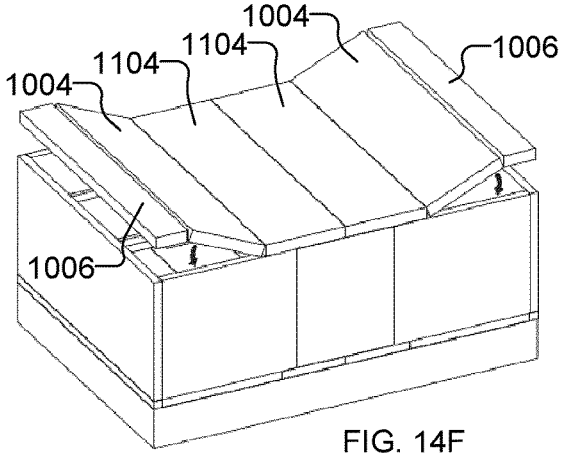

The lower construction of modular building structure 1100 below the roof, including its assembly, folding and unfolding, is the same as described previously for modular building structure 100. However, the roof differs in that the lateral roof panels 1002 comprise a pair of hingedly connected inner and outer lateral roof panels 1004, 1006. As best seen in FIG. 13B, inner lateral roof panel 1004 is hingedly connected to central roof panel 1104 so as to be upwardly rotatable with respect to central roof panel 1104. Thus, rather than folding inwardly and downwardly as described for modular building structure 100, in the folded configuration, the inner and outer lateral roof panels 1004, 1006 fold upwardly and inwardly and sit atop fixed portion 1107 during transport, with inner lateral roof panel 1004 interposing central roof panel 1104 and outer lateral roof panel 1006.

Outer lateral roof panel 1006 is hingedly connected to inner lateral roof panel 1004 so that the inner lateral roof panel 1004 is rotatably connected to outer lateral roof panel 1006. This allows outer lateral roof panel 1006 to be rotated to sit above inner lateral roof panel 1004 during transport. In the folded configuration of modular building structure 1100, central roof panel 1104, inner lateral roof panel 1004 and outer lateral roof panel 1106 extend parallel to and sit vertically on top of one another, with inner lateral roof panel 1004 interposing central roof panel 1104 and outer lateral roof panel 1106. In the deployed configuration of modular building structure 1100, central roof panel 1104, inner lateral roof panel 1004, and outer lateral roof panel 1106 extend parallel to and in the same plane as one another.

Figure 15A:
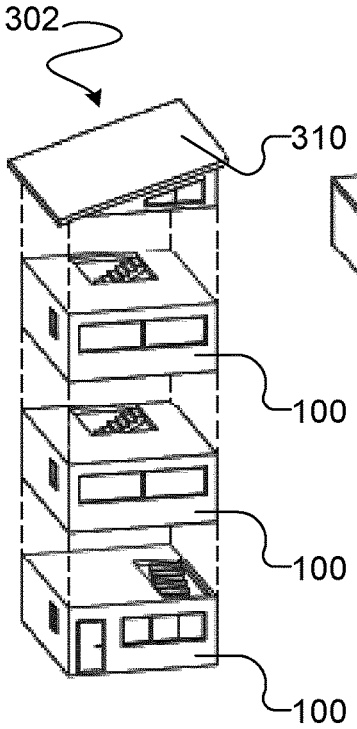
FIGS. 15A-15C illustrate example configurations for a plurality of modular building structures to be used together.
Figure 15B:
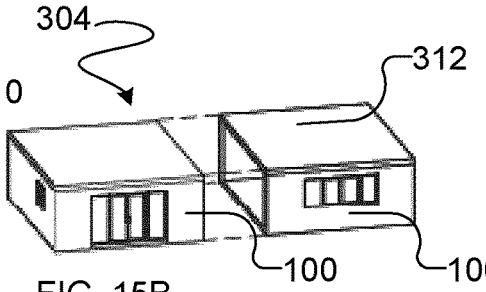
Figure 15C:
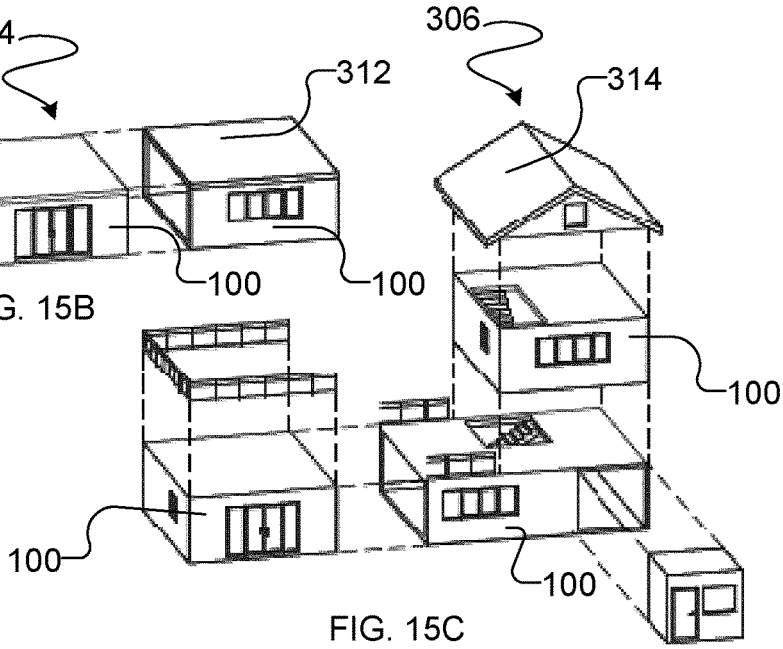

As illustrated with reference to FIGS. 15A, 15B and 15C, a plurality of modular building structures 100 can be coupled together in any desired configuration to build larger structures. For example, as shown in FIG. 15A, two or more modular building structures 100 can be stacked vertically to provide a multi-storey building 302. As shown in FIG. 15B, two or more modular building structures 102 can be connected horizontally to provide a larger single floor building 304. As shown in FIG. 15C, a plurality of modular building structures 100 can be connected horizontally and stacked vertically in any desired orientation to provide a larger multi-storey building 306.

Further with reference to FIG. 15A-15C, any suitable roof structure can be erected on the deployed modular building structure 100, for example a single pitch roof 310, a flat roof 312, or a double pitch roof 314. The exemplary configurations are illustrative only and those skilled in the art will recognize that other configurations and other styles of roof are possible. Further, modular building structure 100 can be provided with any different number and types of windows and doors as may be desired.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A foldable modular building comprising:

a fixed portion comprising:

a central floor panel;

a central roof panel above the central floor panel;

a pair of central sidewalls, each one of the pair of central sidewalls being disposed at opposite ends of the central floor panel, the pair of central sidewalls interposing the central floor panel and the central roof panel;

the central floor panel, the central roof panel, and the pair of central sidewalls together providing the fixed portion of the foldable modular building;

at least one foldable portion comprising:

a lateral floor panel hingedly connected to an outside lateral edge of the central floor panel;

a lateral roof panel hingedly connected to an outside lateral edge of the central roof panel;

a pair of outside wall panels, each one of the pair of outside wall panels being hingedly connected to an outside lateral edge of a corresponding one of the pair of central sidewalls; and an outer lateral sidewall, the outer lateral sidewall being hingedly connected to an outside lateral edge of the lateral floor panel; and a lateral support beam, the lateral support beam being dimensioned to contact an outside lateral edge of the lateral floor panel and a bottom edge of the outer lateral sidewall to interpose the outer lateral sidewall and a foundation, wherein the lateral support beam is positioned under the lateral floor panel and vertically supports the lateral floor panel when the foldable modular building is in a folded configuration.

2. The foldable modular building as defined in claim 1, wherein the at least one foldable portion comprises two foldable portions, each one of the two foldable portions being provided on opposite lateral edges of the fixed portion.

3. The foldable modular building as defined in claim 1, wherein the lateral floor panel is hingedly connected to the central floor panel so that the lateral floor panel is rotatable upwardly and inwardly between a deployed position in which the lateral floor panel is disposed parallel to and in the same plane as the central floor panel and a folded position in which the lateral floor panel extends perpendicular to the central floor panel.

4. The foldable modular building as defined in claim 1, wherein the outer lateral sidewall is hingedly connected at a base of the outer lateral sidewall to an outside lateral edge of the lateral floor panel so that the outer lateral sidewall is rotatable inwardly and downwardly between a deployed position in which the outer lateral sidewall extends vertically perpendicular to the lateral floor panel, and a folded position in which the outer lateral sidewall extends parallel to and sits above the lateral floor panel.

5. The foldable modular building as defined in claim 1, wherein each one of the outside wall panels is hingedly connected to the central sidewall so that each one of the outside wall panels is rotatable horizontally inwardly between a deployed position in which the outside wall panel is disposed parallel to and in the same plane as the central sidewall and a folded position in which the outside wall panel extends perpendicular to the central sidewall.

6. The foldable modular building as defined in claim 1, having a folded configuration in which the outer lateral sidewall extends parallel to and sits adjacent to the lateral floor panel, with the outer lateral sidewall interposing the fixed portion and the lateral floor panel.

7. The foldable modular building as defined in claim 1, wherein the outer lateral sidewall sits above and is supported by the central floor panel when the foldable modular building is in a folded configuration.

8. The foldable modular building as defined in claim 1, having a folded configuration in which the outside wall panels extend parallel to the outer lateral sidewall, and in which the outside wall panels interpose the fixed portion and the outer lateral sidewall.

9. The foldable modular building as defined in claim 1, having a deployed configuration in which the lateral floor panel extends parallel to and in the same plane as the central floor panel, the lateral roof panel extends parallel to and in the same plane as the central roof panel, the outer lateral sidewall extends perpendicularly between the lateral floor panel and the lateral roof panel, each one of the pair of outside wall panels extends parallel to and in the same plane as a corresponding one of the central sidewalls, and the lateral support beam is positioned beneath and vertically supports the outer lateral sidewall.

10. The foldable modular building as defined in claim 1, wherein the central roof panel is wider than the central floor panel by an amount corresponding to a thickness of the lateral floor panel.

11. The foldable modular building as defined in claim 1, wherein a length, width and height of the lateral floor panel is the same as a length, width and height of the outer lateral sidewall, and wherein a length, width and height of the lateral roof panel is the same as a length, width and height of the outer lateral sidewall.

12. The foldable modular building as defined in claim 1, wherein the lateral roof panel is hingedly connected to the central roof panel so that the lateral roof panel is rotatable downwardly and inwardly between a deployed position in which the lateral roof panel is disposed parallel to and in the same plane as the central roof panel and a folded position in which the lateral roof panel extends perpendicular to the central roof panel.

13. The foldable modular building as defined in claim 1, wherein the lateral roof panel is hingedly connected to the central roof panel so as to be upwardly rotatable relative to the central roof panel.

14. The foldable modular building as defined in claim 13, wherein the lateral roof panel comprises at least an inner and an outer lateral roof panel, the inner and the outer lateral roof panels being hingedly connected.

15. The foldable modular building as defined in claim 14, wherein, in a folded configuration, the outer lateral roof panel, the inner lateral roof panel and the central roof panel extend parallel to one another, with the inner lateral roof panel interposing the central roof panel and the outer lateral roof panel.

16. The foldable modular building as defined in claim 14, wherein, in a deployed configuration, the outer lateral roof panel, the inner lateral roof panel, and the central roof panel extend parallel to and in the same plane as one another.

17. The foldable modular building as defined in claim 1 comprising a recessed window, wherein the recessed window comprises a frame inset within the perimeter of an opening in a panel, the frame together with the perimeter of the opening defining a recess within the opening for receiving the window to allow the window to be installed flush with the outer surface of the panel.

18. A method of deploying a foldable modular building, the method comprising the steps of:

rotating a unit comprising an outer lateral sidewall and a lateral floor panel outwardly and downwardly away from a fixed portion of the foldable modular building until the unit extends parallel to a central floor panel of the fixed portion with the lateral floor panel extending in the same plane as the central floor panel and the outer lateral sidewall stacked above the lateral floor panel;

positioning a lateral support beam adjacent an outer lateral edge of the lateral floor panel, wherein the lateral support beam is positioned under the lateral floor panel and vertically supports the lateral floor panel when the foldable modular building is in a folded configuration prior to said rotating;

rotating the outer lateral sidewall upwardly and outwardly relative to the lateral floor panel until the outer lateral sidewall extends perpendicularly upwardly from the lateral floor panel, with the lateral support beam interposing the outer lateral sidewall and a foundation on which the foldable modular building is deployed; and rotating outside wall panels horizontally and outwardly away from the fixed portion until the outside wall panels extend parallel to and in the same plane as central sidewalls of the fixed portion.

* * * * *